US010143353B2

(12) United States Patent
Jung et al.

(10) Patent No.: US 10,143,353 B2
(45) Date of Patent: Dec. 4, 2018

(54) DISHWASHER AND METHOD FOR CONTROLLING SAME

(71) Applicant: SAMSUNG ELECTRONICS CO., LTD., Suwon-si, Gyeonggi-do (KR)

(72) Inventors: Min Ho Jung, Suwon-si (KR); Chang Wook Lee, Seoul (KR); Hyun Dong Jung, Suwon-si (KR); Jong Youb Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/108,687

(22) PCT Filed: Dec. 29, 2014

(86) PCT No.: PCT/KR2014/012956
§ 371 (c)(1),
(2) Date: Jun. 28, 2016

(87) PCT Pub. No.: WO2015/102330
PCT Pub. Date: Jul. 9, 2015

(65) Prior Publication Data

US 2016/0316993 A1 Nov. 3, 2016

(30) Foreign Application Priority Data

Dec. 31, 2013 (KR) ..... 10-2013-0169524

(51) Int. Cl.
*A47L 15/42* (2006.01)
*A47L 15/16* (2006.01)
*A47L 15/46* (2006.01)

(52) U.S. Cl.
CPC ..... *A47L 15/4289* (2013.01); *A47L 15/16* (2013.01); *A47L 15/4221* (2013.01);
(Continued)

(58) Field of Classification Search
CPC .. A47L 15/16; A47L 15/4282; A47L 15/4221; A47L 15/4289; A47L 15/4225;
(Continued)

(56) References Cited

U.S. PATENT DOCUMENTS 2,236,791 A 4/1941 Forsberg
2004/0003833 A1 1/2004 Elick et al.
(Continued)

FOREIGN PATENT DOCUMENTS

CN 202960423 6/2013
CN 103462574 12/2013
(Continued)

OTHER PUBLICATIONS

International Search Report dated Apr. 1, 2015 in corresponding International Patent Application No. PCT/KR2014/012956.
(Continued)

*Primary Examiner* — Michael E Barr
*Assistant Examiner* — Benjamin L Osterhout
(74) *Attorney, Agent, or Firm* — Staas & Halsey LLP

(57) ABSTRACT

The present invention relates to a dishwasher and a method for controlling same, and the dishwasher may comprise a wash tub having an opening on at least one side thereof; a spray nozzle, provided in the interior of the wash tub, for spraying wash water; a reflecting module capable of moving in the interior of the wash tub, and reflecting the wash water sprayed by the spray nozzle; and a moving module, to which the reflecting module is detachably attached, for moving same in at least one direction.

12 Claims, 52 Drawing Sheets

(52) U.S. Cl.
CPC ..... *A47L 15/4225* (2013.01); *A47L 15/4282* (2013.01); *A47L 15/46* (2013.01); *A47L 2401/08* (2013.01); *A47L 2501/04* (2013.01); *A47L 2501/20* (2013.01)

(58) Field of Classification Search
CPC .. A47L 15/46; A47L 2501/20; A47L 2401/08; A47L 2501/04
See application file for complete search history.

(56) References Cited

U.S. PATENT DOCUMENTS

| | | | | |
|---|---|---|---|---|
| 2005/0022849 | A1* | 2/2005 | Park ..... | A47L 15/4221 134/58 D |
| 2005/0150529 | A1 | 7/2005 | Vanderroest et al. | |
| 2009/0056754 | A1 | 3/2009 | Rolek | |
| 2013/0319487 | A1 | 12/2013 | Hong et al. | |

FOREIGN PATENT DOCUMENTS

| | | | |
|---|---|---|---|
| EP | 1488730 | | 12/2004 |
| EP | 2671494 | A1 | 12/2013 |
| KR | 10-2013-0081115 | | 7/2013 |

OTHER PUBLICATIONS

International Written Opinion of the International Searching Authority dated Apr. 1, 2015 in corresponding International Patent Application No. PCT/KR2014/012956.
Extended European Search Report dated Nov. 7, 2017 in corresponding European Patent Application No. 14876178.6, 12 pp.
European Search Report dated Jul. 31, 2017 in corresponding European Patent Application No. 14876178.6.
Chinese Office Action dated Jun. 20, 2018 in Chinese Patent Application No. 201480075548.0.

* cited by examiner

DISHWASHER AND METHOD FOR CONTROLLING SAME

CROSS-REFERENCE TO RELATED APPLICATIONS

This application is a U.S. National Stage Application, which claims the benefit under 35 U.S.C. § 371 of PCT International Patent Application No. PCT/KR2014/012956, filed Dec. 29, 2014, which claims the foreign priority benefit under 35 U.S.C. § 119 of Korean Patent Application No. 10-2013-0169524, filed Dec. 31, 2013, the contents of which are incorporated herein by reference.

TECHNICAL FIELD

The present disclosure relates to a dishwasher and a method for controlling the same.

BACKGROUND ART

A dishwasher is an apparatus that washes dishes by spraying wash water having high pressure onto dishes stored in a dish accommodation unit to remove foreign substances and the like remaining on the dishes using a water pressure of the sprayed wash water. Dishwashers may be used in households and may also be used in industrial sites.

A dishwasher may include a main body having a wash tub structurally provided inside it for washing dishes, a dish storage unit that stores dishes, a sump that retains wash water, a spray nozzle that sprays the wash water, and a pump that supplies the wash water in the sump to the spray nozzle. A rotary nozzle that sprays the wash water onto dishes and the like while rotating may be provided in the wash tub inside the dishwasher. The rotary nozzle may rotate by the water pressure of the sprayed wash water while spraying the wash water. Accordingly, the wash water may reach dishes within a range of a radius of rotation and the dishes may be washed. In addition, a fixed nozzle that is fixed to one side of the wash tub and sprays wash water may also be provided in the dishwasher. The fixed nozzle may spray wash water having a predetermined water pressure in a predetermined direction toward dishes to allow the dishes to be washed.

DISCLOSURE

Technical Problem

It is an aspect to provide a dishwasher in which sprayed wash water can properly reach a reflecting module, and a method for controlling the same.

It is another aspect to provide a dishwasher that includes a spray nozzle in which a spray angle, a spray direction, or a spray position is controllable so that wash water can be properly reflected by a reflecting module according to a position of the reflecting module.

It is still another aspect to provide a dishwasher that includes a reflecting module in which sprayed wash water is incident on a position suitable for reflection and which is capable of reflecting the arriving wash water toward dishes or a rail assembly.

Technical Solution

To achieve the aspects mentioned above, a dishwasher and a method for controlling the same are provided.

A dishwasher includes a wash tub, a spray nozzle that sprays wash water inside the wash tub, a reflecting module that is movable inside the wash tub and reflects the wash water sprayed by the spray nozzle, and a control unit that controls a spray pressure at which the wash water is sprayed according to a position of the reflecting module.

The dishwasher may further include a sump that retains the wash water and a circulation pump that transfers the wash water retained in the sump to the spray nozzle.

The control unit may determine the spray pressure of the wash water according to the position of the reflecting module and may control a transfer force of the circulation pump according to the determined spray pressure.

The circulation pump may include a brushless direct current (BLDC) motor.

The dishwasher may further include a detection unit that detects a position of the dishwasher.

At least one of a wash water spray height and a wash water spray angle of the spray nozzle may be controllable. In addition, a length of the spray nozzle may be varied.

A spray angle of the spray nozzle may be controllable by a reaction force of the sprayed wash water.

The dishwasher may further include a rail assembly that includes a rail for guiding a movement of the reflecting module.

The rail may be in an inclined shape to descend in an opposite direction of the spray nozzle.

The rail may also be in a shape of a curve having a central portion protruding upward.

The reflecting module may include a first reflecting surface disposed at a front surface and a second reflecting surface disposed behind the first reflecting surface, and the second reflecting surface may move to protrude from the reflecting module.

A dishwasher includes a wash tub, a spray nozzle that sprays wash water inside the wash tub, and a reflecting module that is movable inside the wash tub and reflects the wash water sprayed by the spray nozzle, wherein at least one of a wash water spray height and a wash water spray angle of the spray nozzle may be controlled.

At least one of the wash water spray height and the wash water spray angle may be controlled according to a distance between the spray nozzle and the reflecting module.

A dishwasher includes a wash tub, a spray nozzle that sprays wash water inside the wash tub, and a reflecting module that is movable inside the wash tub and reflects the wash water sprayed by the spray nozzle, wherein a length of the spray nozzle may be varied.

The length of the spray nozzle may be extended or shortened according to a distance between the spray nozzle and the reflecting module.

A dishwasher includes a wash tub, a spray nozzle that sprays wash water inside the wash tub, a reflecting module that is movable inside the wash tub and reflects the wash water sprayed by the spray nozzle, and a rail assembly that includes a rail for guiding a movement of the reflecting module, wherein the rail may be in an inclined shape to descend in an opposite direction of the spray nozzle or may be in a shape of a curve having a central portion protruding upward.

A dishwasher includes a wash tub, a spray nozzle that sprays wash water inside the wash tub, and a reflecting module that is movable inside the wash tub and reflects the wash water sprayed by the spray nozzle, wherein the reflecting module may include a first reflecting surface disposed at a front surface and a second reflecting surface disposed behind the first reflecting surface, and the second reflecting surface may move upward to protrude from the reflecting module.

The second reflecting surface may protrude from the reflecting module or be inserted into the reflecting module according to a distance between the spray nozzle and the reflecting module.

A method for controlling a dishwasher may be performed in a dishwasher including a circulation pump that transfers wash water, a spray nozzle that sprays the wash water transferred by the circulation pump, and a reflecting module that is movable and reflects the wash water sprayed by the spray nozzle, and the method for controlling the dishwasher includes detecting a position of a reflecting module and determining a distance between the reflecting module and a spray nozzle based on a detection result, determining a spray pressure of the spray nozzle according to the distance between the reflecting module and the spray nozzle, changing a transfer force of the circulation pump based on the determined spray pressure, and changing the spray pressure according to the changed transfer force of the circulation pump.

Advantageous Effects

According to a dishwasher and a method for controlling the same described above, an effect in which wash water sprayed by a nozzle is properly incident on a reflecting module can be obtained, and accordingly, an effect in which the reflecting module can reflect the incident wash water in a proper direction with a proper strength can also be obtained.

According to a dishwasher described above, a spray direction, a spray strength, a spray position, etc. of wash water sprayed by a nozzle can be precisely controlled according to a position of a reflecting module such that an effect in which the wash water can stably reach the reflecting module can be obtained, and an effect of improving efficiency of washing dishes can also be obtained.

In addition, according to the dishwasher described above, the waste of wash water can be reduced since the sprayed wash water can stably reach the reflecting module, and washing dishes can be more effectively performed since the reflecting module can properly reflect the wash water toward the dishes such that, ultimately, an advantage of improving dish washing efficiency of the dishwasher can be obtained.

According to a dishwasher described above, a spray angle, a spray direction, or a spray position of a nozzle can be properly controlled as needed according to a position of a reflecting module such that an effect in which wash water can be stably incident on the reflecting module can also be obtained.

According to a dishwasher described above, the linearity of wash water sprayed by a nozzle is secured such that an advantage in which the wash water is properly and stably incident on a reflecting module even when there is a long distance between the reflecting module and the nozzle can also be obtained.

According to a dishwasher described above, effects in which sprayed wash water can be incident on a position suitable for reflection and, further, the arriving wash water can be reflected toward dishes can be obtained.

Furthermore, according to a dishwasher described above, even when there is a long distance between a reflecting module and a nozzle, an effect in which sprayed wash water is incident on and reflected to a proper position even without controlling the nozzle can be obtained.

MODES OF THE INVENTION

Figure 1:
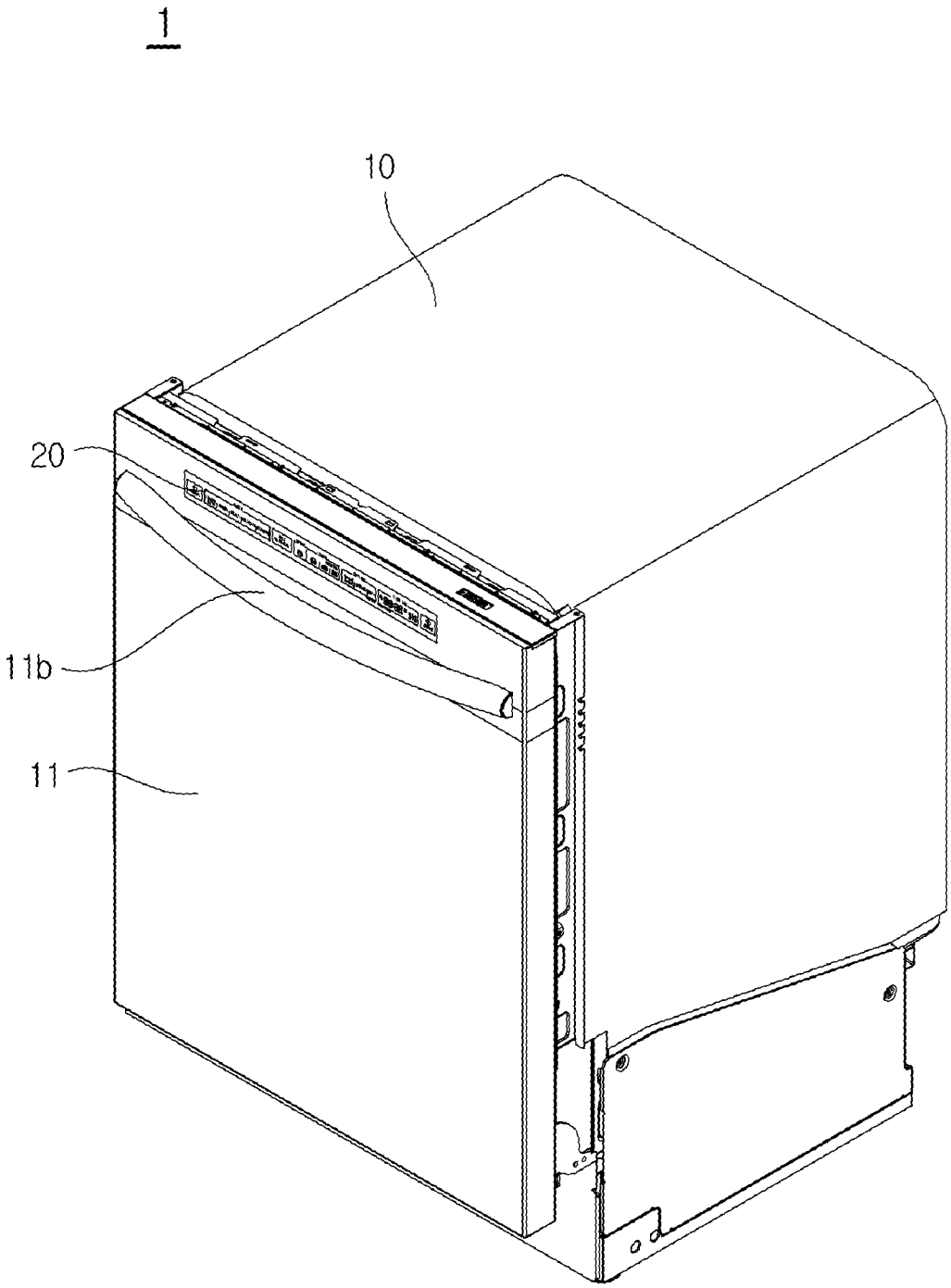
FIG. 1 is a perspective view of an embodiment of a dishwasher.
Figure 2:
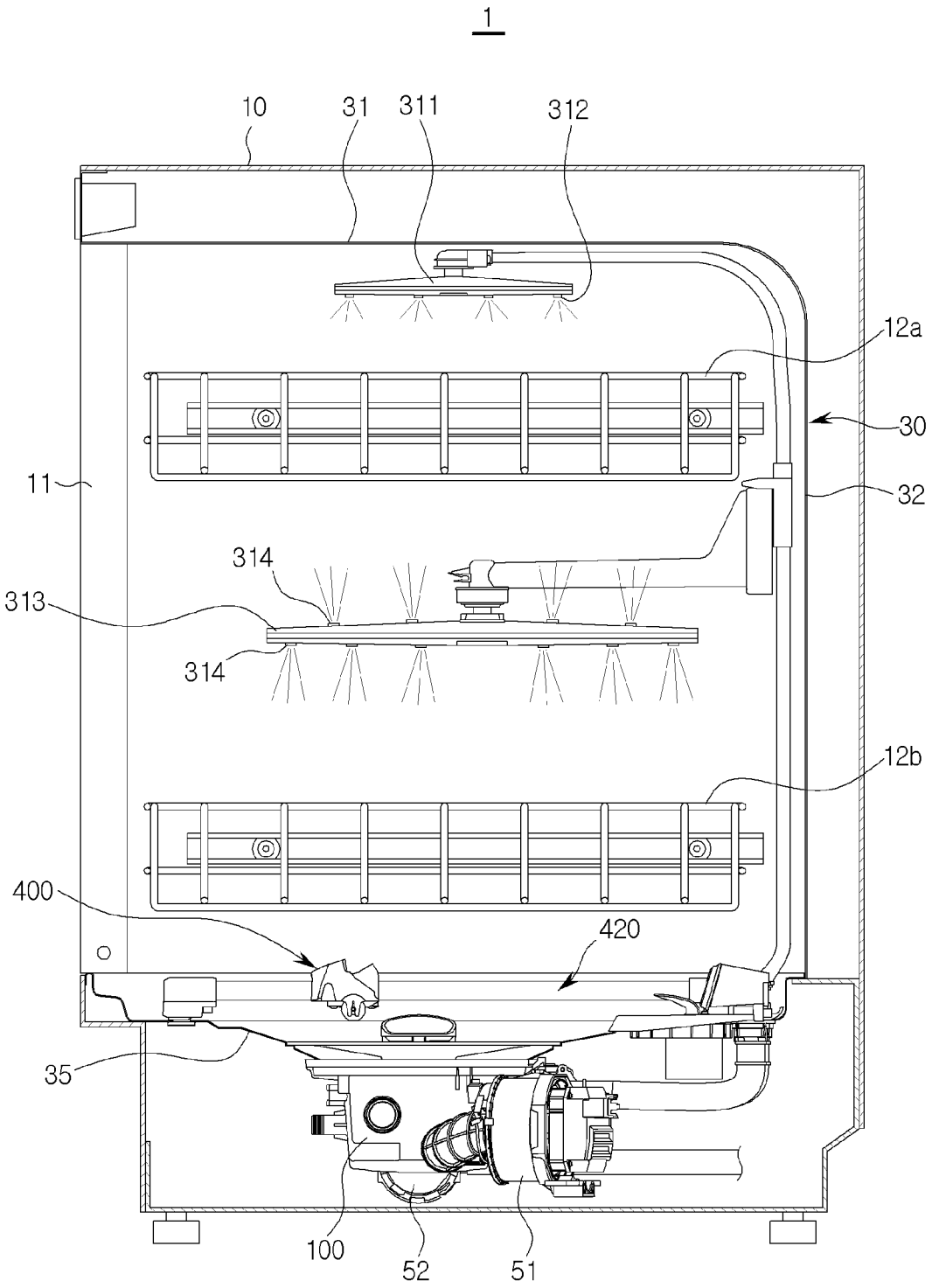
FIG. 2 is a schematic cross-sectional view of the embodiment of the dishwasher.
Figure 3:
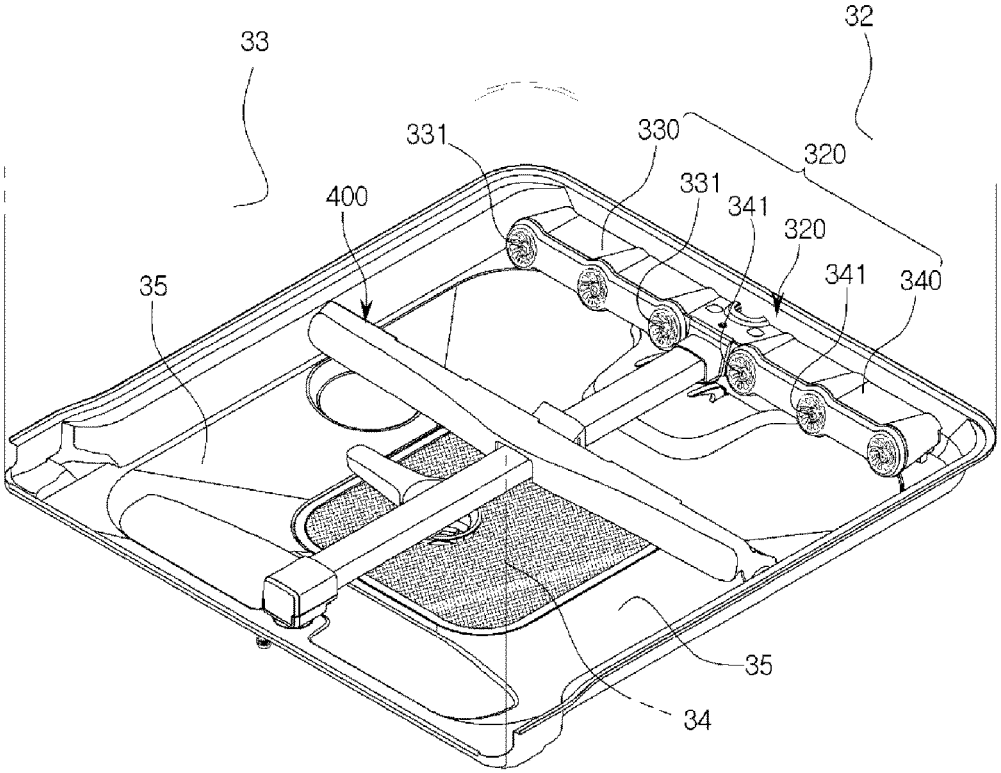
FIG. 3 is a perspective view of an embodiment of a lower portion of the dishwasher.
Figure 4:
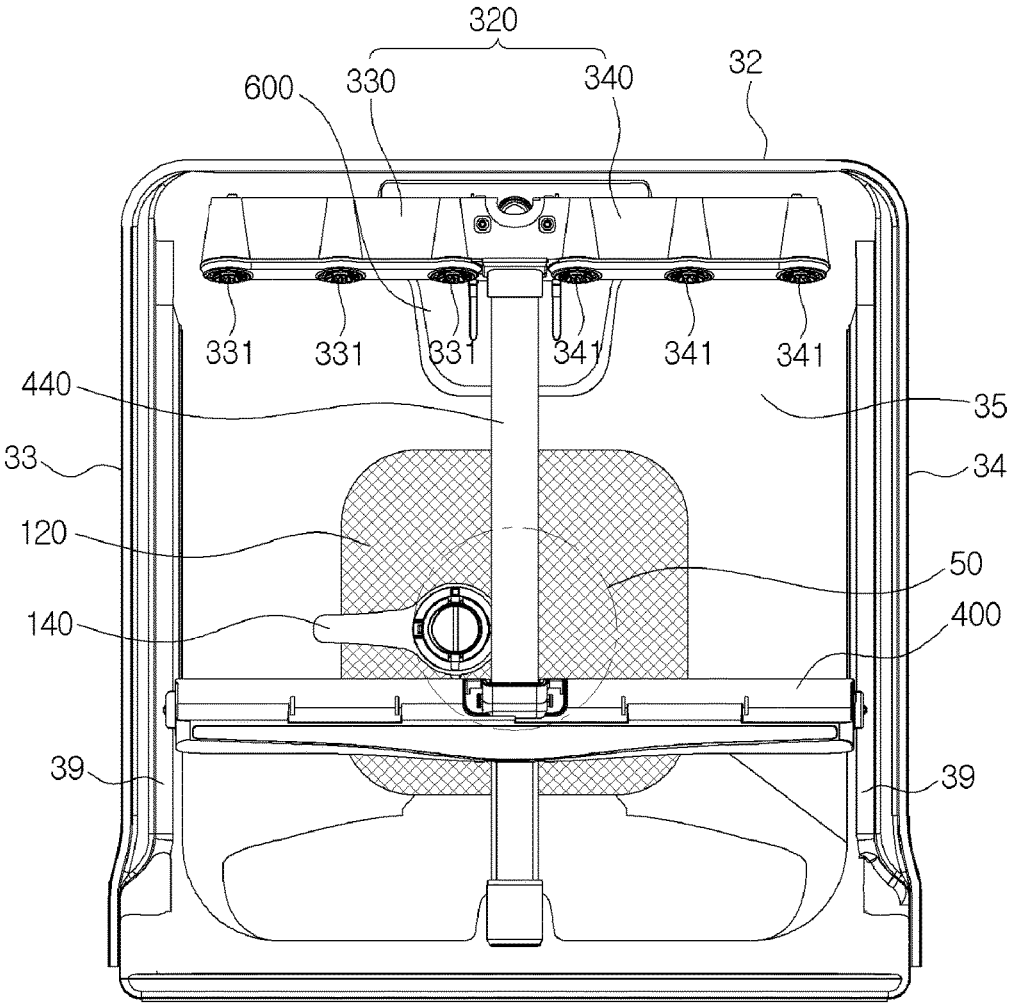
FIG. 4 is a plan view of the embodiment of the lower portion of the dishwasher.

Hereinafter, an overall structure of an embodiment of a dishwasher 1 will be generally described with reference to FIGS. 1 to 4. FIG. 1 is a perspective view of an embodiment of a dishwasher, and FIG. 2 is a schematic cross-sectional view of the embodiment of the dishwasher. FIG. 3 is a perspective view of an embodiment of a lower portion of the dishwasher, and FIG. 4 is a plan view of the embodiment of the lower portion of the dishwasher.

Referring to what is illustrated in FIG. 1, the dishwasher 1 may include a main body 10 that forms an exterior and has a wash tub 30 provided therein. The main body 10 may be in the shape of a box as illustrated in FIG. 1. However, the shape of the main body 10 is not limited to that illustrated in FIG. 1, and may also be formed in the shape of a cylinder or a polygonal column, or may also be formed in the shape of a polygonal box besides a hexahedron. Other than above, the dishwasher 1 may be formed in various shapes that may be applied as an outer shape.

A user interface may be installed at an outer surface of the main body 10. A user interface 20 may include an input unit that receives a predetermined instruction from a user. An input unit 20*a* may include at least one of a keyboard, a mouse, a track-ball, a touch screen, a touch pad, a paddle, various types of levers or handles, a joystick, and other various input means. According to an embodiment, the input unit 20*a* may also be installed at an external device connected to the dishwasher 1. The external device may include a personal computer (PC), a smartphone, a tablet PC, a personal digital assistant (PDA), a cellular phone, a remote controller, etc. The user interface 20 may include a display unit 20*b* for displaying various types of information to the user. The display unit 20*b* may include a display means using a plasma display panel (PDP), a light emitting diode (LED), an organic light emitting diode (OLED), a liquid crystal display (LCD), or the like. The display unit 20*b* may also express a three-dimensional image.

A door 11 through which dishes may be inserted and withdrawn may be provided at one surface of the main body 10. The door 11 may be opened and closed by being moved in a predetermined direction as illustrated in FIG. 2. According to an embodiment, a hinge that rotates a body of the door 11 in a predetermined direction may be provided at one end of the door 11. According to an embodiment, the door 11 may also be opened and closed by a sliding means. The door 11 may be provided in front of an opening 11*a* of a wash tub 30, and the user may store dishes in the wash tub 30 through the open door 11 and the opening 11*a*. A handle 11*b* may be provided at the door 11 so that the user can easily open and close the door 11. According to an embodiment, the user interface 20 such as the input unit 20*a* or the display unit 20*b* may also be installed at the door 11. The user interface 20 may also be installed near the handle 11*b*.

Referring to what is illustrated in FIG. 2, the wash tub 30 in which dishes are washed may be provided inside the main body 10. The wash tub 30 may be formed in a shape corresponding to the outer shape of the main body 10. For example, the wash tub 30 may be formed in the shape of a box. Although an embodiment in which the wash tub 30 is formed in the shape of a hexahedral box is illustrated in FIG. 2, the shape of the wash tub 30 is not limited thereto. The wash tub 30 may also be formed in the shape of a cylinder or a polygonal column, or may also be formed in the shape of a polygonal box besides a hexahedron. In addition, the wash tub 30 does not always have to be formed in a shape corresponding to the outer shape of the main body 10.

The opening 11*a* through which dishes may be inserted or withdrawn in at least one direction may be provided at one surface of the wash tub 30. The opening 11*a* may be opened and closed by the door 11. The wash tub 30 may include a plurality of walls 31 to 34 and a bottom plate 35. Hereinafter, while describing the wash tub 30, a direction and an area in which the bottom plate 35 is disposed will be referred to as a lower direction or a lower portion, and a direction opposite the direction in which the bottom plate 35 is disposed will be referred to as an upper direction or an upper portion. A direction in which the opening 11*a* is disposed will be referred as the front, and a direction opposite the direction in which the opening 11*a* is disposed will be referred to as the rear. In addition, a wall disposed at the opposite side of the opening 11*a* will be referred to as a rear wall 32, a wall disposed at the left when viewed from the opening 11*a* will be referred to as a left wall 33, and a wall disposed at the right when viewed from the opening 11*a* will be referred to as a right wall 34. Furthermore, a wall disposed at the opposite side of the bottom plate 35 of the wash tub 30 will be referred to as an upper wall 31.

Referring to FIGS. 2 to 4, inside the wash tub 30, dish accommodation units 12*a* and 12*b* in which dishes are mounted, a nozzle assembly 300 that sprays wash water to the dish accommodation units 12*a* and 12*b* or a reflecting module 400, the reflecting module 400 that reflects the wash water sprayed from spray nozzles 311, 313, and 320 of the nozzle assembly 300 toward the dishes while moving inside the wash tub 30, a moving module 420 that moves the reflecting module 400, a sump 100 that retains wash water, a circulation pump 51 that pumps the wash water in the sump 100 to supply the wash water to the nozzle assembly 300, and a drainage pump 52 that discharges the wash water in the sump 100 together with scraps to the outside of the main body 10.

The dish accommodation units 12*a* and 12*b* may be in the shape of a basket in which pins and the like are formed. The basket may be a wire rack formed of a wire so that the wash water can pass therethrough without pooling. The dish accommodation units 12*a* and 12*b* may be detached from the wash tub 30. The dish accommodation units 12*a* and 12*b* may also be withdrawn outside of the opening 11*a* using a rail and a roller (not shown), etc. provided at the left wall 33 and the right wall 34 inside the wash tub 30. The withdrawal of the dish accommodation units 12*a* and 12*b* may be performed manually or automatically. The dish accommodation units 12*a* and 12*b* may include an upper dish accommodation unit 12*a* disposed at an upper portion of the wash tub 30 and a lower dish accommodation unit 12*b* disposed at a lower portion of the wash tub 30.

Figure 5:
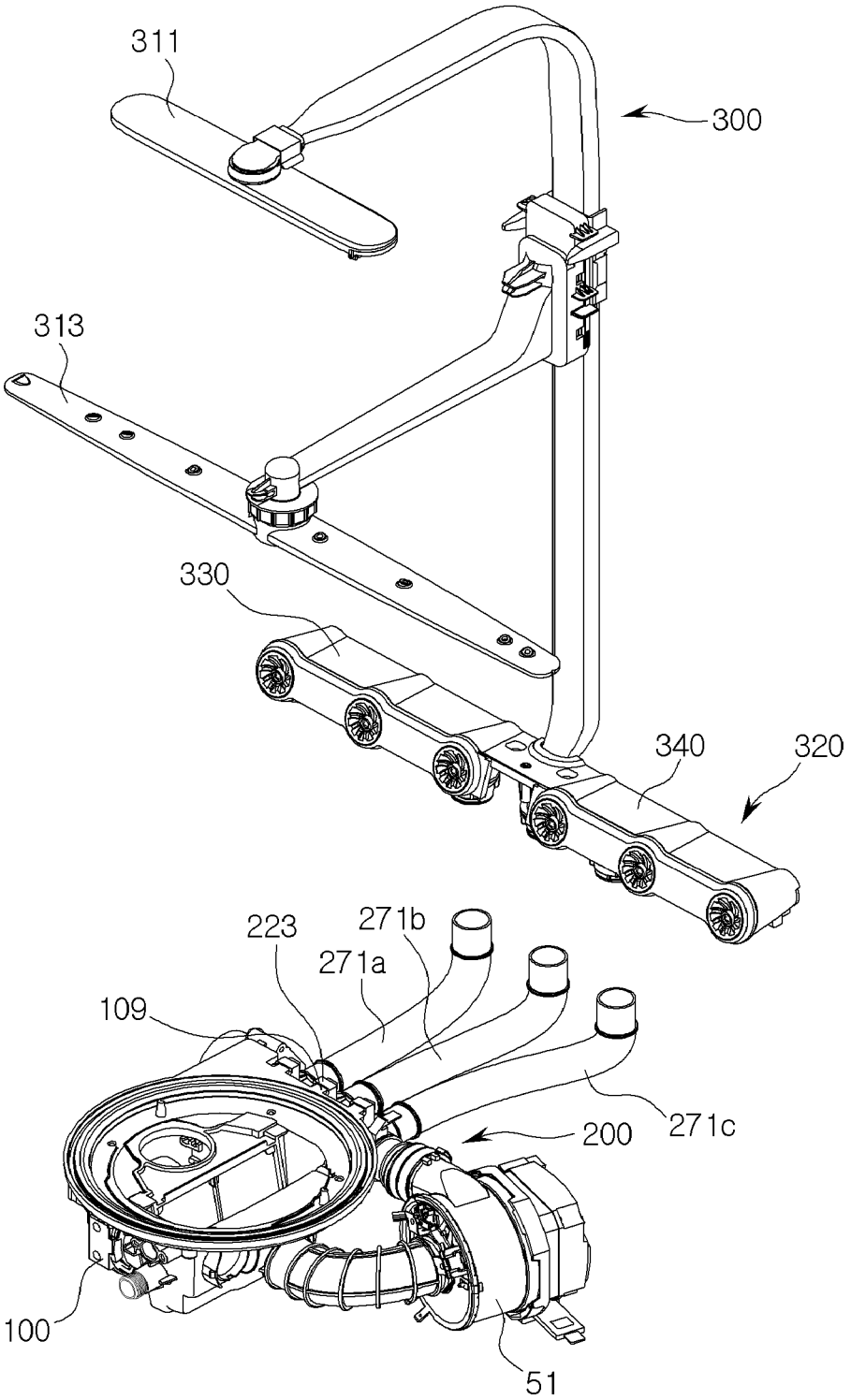
FIG. 5 is a view illustrating an embodiment of a nozzle assembly and a sump.

FIG. 5 is a view illustrating an embodiment of a nozzle assembly and a sump. Referring to what is illustrated in FIG. 5, the nozzle assembly 300 may include an upper rotary nozzle assembly 311 provided at the upper portion of the wash tub 30, a middle rotary nozzle assembly 313 provided at a central portion of the wash tub 30, and a fixed nozzle assembly 320 provided at the lower portion of the wash tub 30. Each of the nozzle assemblies 311, 313, 330, and 340 may spray wash water with high pressure to wash dishes.

The upper rotary nozzle assembly 311 may be provided above the upper dish accommodation unit 12*a* and spray the wash water toward the upper dish accommodation unit 12*a* while rotating by a water pressure. A spray nozzle 312 through which the wash water is sprayed may be provided at a lower end of the upper rotary nozzle assembly 311 as illustrated in FIG. 2. The upper rotary nozzle assembly 311 may directly spray the wash water toward dishes stored in the upper dish accommodation unit 12*a*.

The middle rotary nozzle assembly 313 may be disposed between the upper dish accommodation unit 12*a* and the lower dish accommodation unit 12*b*. The middle rotary nozzle assembly 313 may spray the wash water in upper and lower directions while rotating by the water pressure like the upper rotary nozzle assembly 311. A rotational direction of the middle rotary nozzle assembly 313 may be the same as or different from that of the upper rotary nozzle assembly 311. Spray nozzles 314 may be provided at an upper end and a lower end of the middle rotary nozzle assembly 313. The wash water may be sprayed onto the dishes accommodated in the upper dish accommodation unit 12*a* and the lower dish accommodation unit 12*b* through the spray nozzles 314.

The fixed nozzle assembly 320 may be fixed to one side of the wash tub 30 as illustrated in FIGS. 2 to 4. The fixed nozzle assembly 320 may be disposed adjacent to the rear wall 32 of the wash tub 30. FIG. 5 is a perspective view illustrating the embodiment of the fixed nozzle assembly and the reflecting module. As illustrated in FIG. 5, the fixed nozzle assembly 320 may include a left fixed nozzle 330 and a right fixed nozzle 340. A plurality of spray nozzles 331 and 341 arranged in a horizontal direction may be provided at each of the left fixed nozzle 330 and the right fixed nozzle 340. The spray nozzles 331 and 341 may spray the wash water toward the front of the wash tub 30. According to an embodiment, the fixed nozzle assembly 320 may spray the wash water independent of the rotary nozzle assemblies 311 and 313. Consequently, the dishwasher 1 may also perform dish washing only with wash water sprayed in a particular direction. In addition, the left fixed nozzle 330 and the right fixed nozzle 340 of the fixed nozzle assembly 320 may also spray wash water independent of each other. Consequently, the dishwasher 1 may be subdivided into particular areas.

The wash water sprayed by the fixed nozzle assembly 320 may be reflected toward the dishes by the reflecting module 400 provided in front of the spray nozzles 331 and 341. The reflecting module 400 may longitudinally extend in the horizontal direction of the wash tub 30 to be able to reflect the wash water sprayed by the plurality of spray nozzles 331 and 341 of the fixed nozzle assembly 320 as illustrated in FIGS. 3 and 4. In other words, one end portion in a longitudinal direction of the reflecting module 400 may be provided to be adjacent to the left wall 33 of the wash tub 30, and the other end portion in the longitudinal direction of the reflecting module 400 may be provided to be adjacent to the right wall 34 of the wash tub 30. The reflecting module 400 may linearly reciprocate along front and rear directions of the wash tub 30.

The reflecting module 400 may reflect the wash water sprayed by the fixed nozzle assembly 320 in the upper direction or the lower direction. When the fixed nozzle assembly 320 is disposed below the lower dish accommodation unit 12*b* as illustrated in FIG. 4, the reflecting module 400 may reflect the sprayed wash water in the upper direction to allow the wash water to reach dishes stored in the upper dish accommodation unit 12*a* or dishes stored in the lower dish accommodation unit 12*b*. When the fixed nozzle assembly 320 is disposed between the upper dish accommodation unit 12*a* and the lower dish accommodation unit 12*b*, the reflecting module 400 may reflect the wash water in the upper direction or the lower direction to allow the wash water to be transferred to dishes stored in the upper dish accommodation unit 12*a* or the lower dish accommodation unit 12*b*. When the fixed nozzle assembly 320 is disposed above the upper dish accommodation unit 12*a*, the reflecting module 400 may reflect the wash water in the lower direction to allow the wash water to be transferred to the dishes stored in the upper dish accommodation unit 12*a* or the lower dish accommodation unit 12*b*.

The wash water sprayed by the left fixed nozzle 330 may be reflected only to a left area of the wash tub 30 by the reflecting module 400, and the wash water sprayed by the right fixed nozzle 340 may be reflected only to a right area of the wash tub 30 by the reflecting module 400. In this case, when the left fixed nozzle 330 and the right fixed nozzle 340 of the fixed nozzle assembly 320 spray the wash water independent of each other, a left side and a right side of the dishwasher 1 may be separately washed independent of each other. Of course, washing areas of the dishwasher 1 may be further subdivided and separately washed as needed.

Referring to what is illustrated in FIG. 4, a drainage hole 50 for draining the wash water into the sump 100 may be formed at the bottom plate 35 of the wash tub 30. The bottom plate 35 of the wash tub 30 may have a slope toward the drainage hole 50 so that the wash water is guided toward the drainage hole 50 by gravity. Referring to what is illustrated in FIGS. 2 and 5, the sump 100 may have a semispherical shape in which a substantially upper surface is open. The sump 100 may include a bottom portion 101, a side wall portion 103, a water retaining chamber 110 formed at the bottom portion 101 and the side wall portion 103 and in which wash water is retained, a circulation port 107 to which the circulation pump 51 is connected, and a drainage port 108 to which the drainage pump 52 is connected. As illustrated in FIG. 5, a circulation pipe 51*a* which is a passage of wash water moving to the circulation pump 51 and a drainage hole 52*a* for discharging wash water and scraps to the outside may be provided at the sump 100. The circulation pump 51 may be connected to a distribution device 200 that distributes wash water to each of the nozzle assemblies 311, 313, 330 and 340 of the nozzle assembly 300. Meanwhile, each of the nozzle assemblies 311, 313, 330 and 340 may spray the wash water onto dishes or the reflecting module 400. The wash water used in washing dishes may move to the lower end of the wash tub 30 to be retained in the sump 100.

Figure 6:
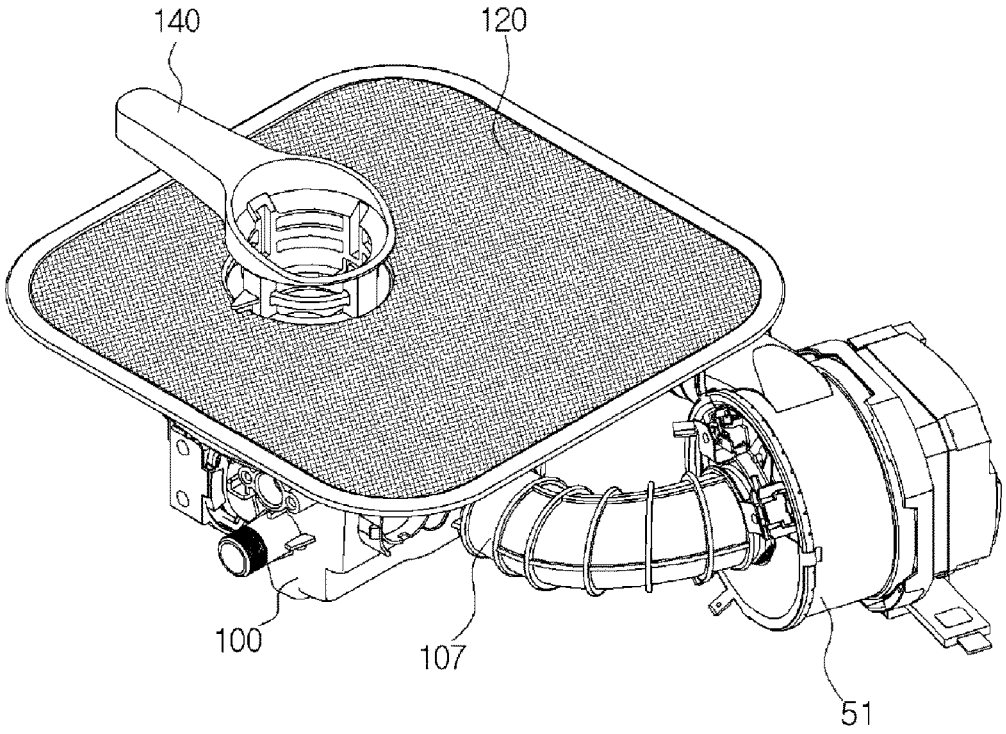
FIG. 6 is a view illustrating a structure in which the sump, a coarse filter, and a fine filter of the dishwasher are coupled.
Figure 7:
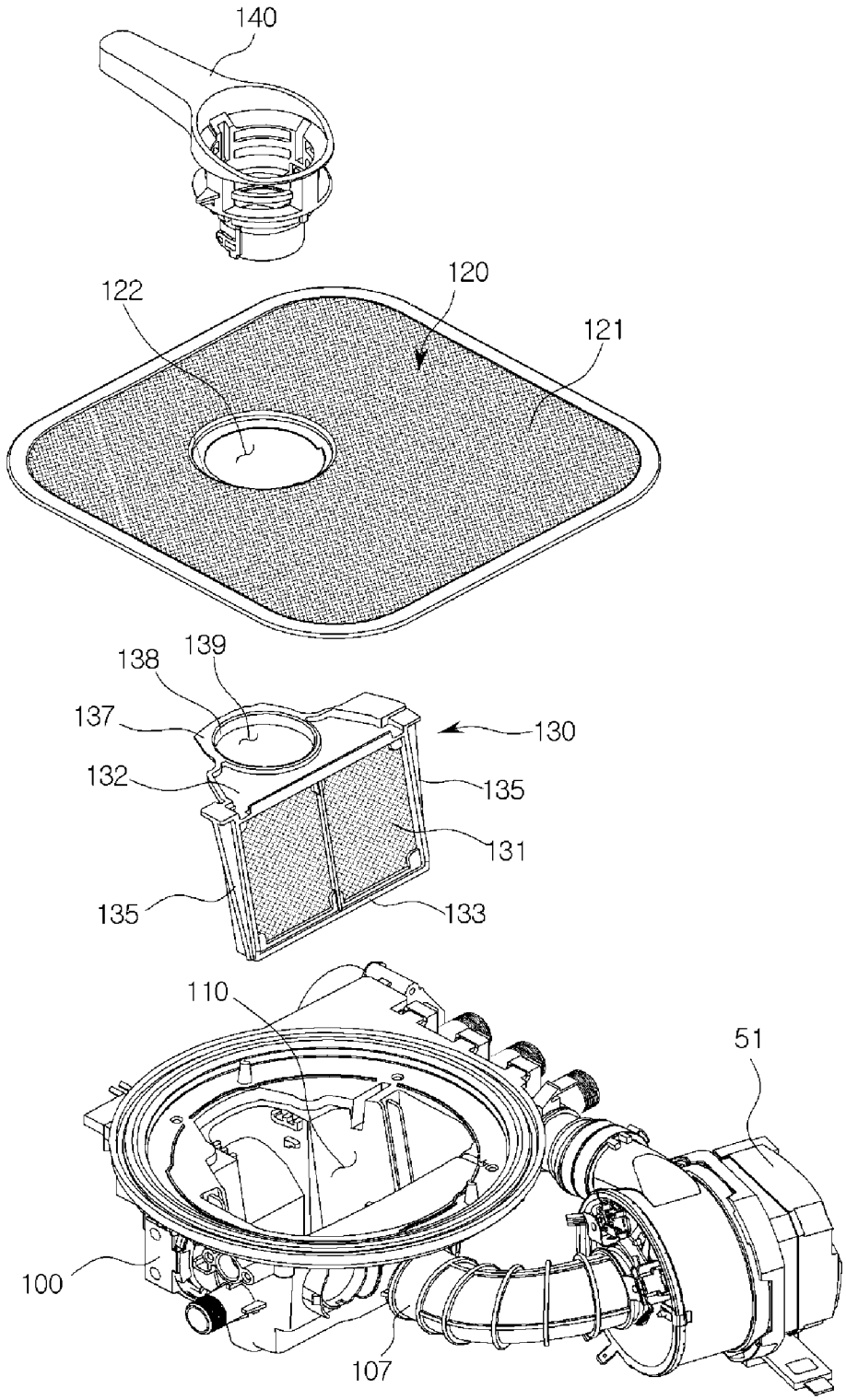
FIG. 7 is a view illustrating the sump, the coarse filter, and the fine filter of the dishwasher.
Figure 8:
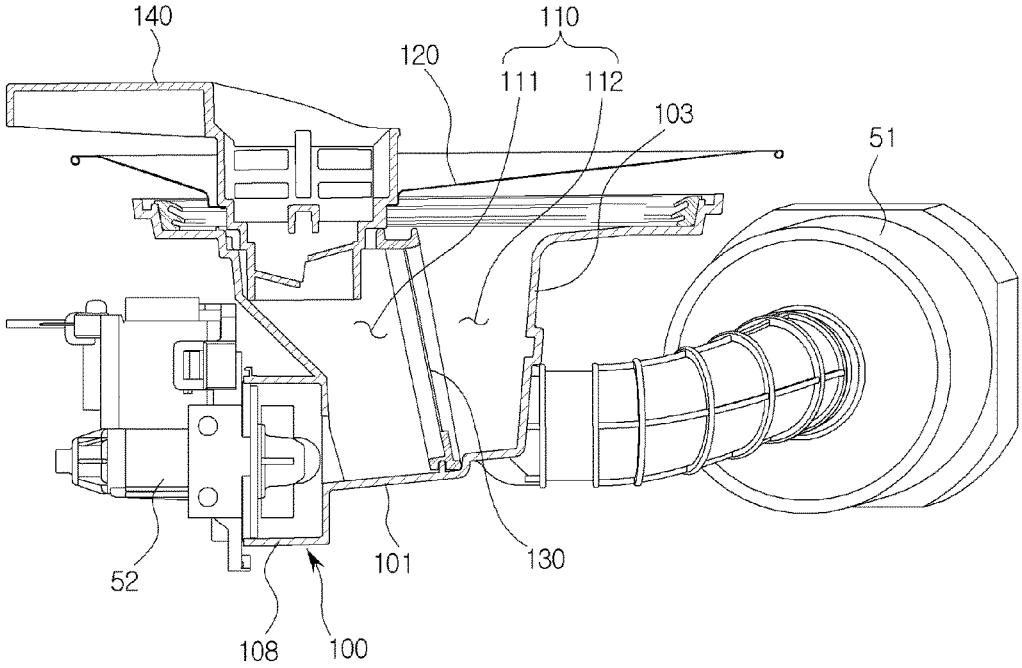
FIG. 8 is a cross-sectional view of the structure in which the sump, the coarse filter, and the fine filter of the dishwasher are coupled.

FIG. 6 is a view illustrating a structure in which the sump, a coarse filter, and a fine filter of the dishwasher are coupled, FIG. 7 is a view illustrating the sump, the coarse filter, and the fine filter of the dishwasher, and FIG. 8 is a cross-sectional view of the structure in which the sump, the coarse filter, and the fine filter of the dishwasher are coupled.

The dishwasher 1 may further include filters 120, 130, and 140 for filtering scraps contained in the wash water. The filters 120, 130, and 140 may include a fine filter 120 mounted on the drainage hole 50 of the bottom plate 35, a coarse filter 140 mounted on the sump 100, and a micro filter 130.

The coarse filter 140 may have a substantially cylindrical shape. The coarse filter 140 may be mounted on an inner surface of the side wall portion 103 of the sump 100. The coarse filter 140 may have a filter unit that filters relatively large-sized scraps and a handle for mounting the coarse filter 140. A filter unit 142 of the coarse filter 140 may be formed at a circumferential surface of the coarse filter 140. The coarse filter 140 is mounted on the sump 100 by passing through a through-hole 139 of the micro filter 130 and a through-hole 122 of the fine filter. An upper portion of the coarse filter 140 protrudes toward an inside of the wash tub 30, and a lower portion thereof protrudes toward a scrap collecting chamber 111 of the sump 100. The scrap collecting chamber 111 will be described below.

The fine filter 120 may have a filter unit 121 that filters relatively mid-sized or larger scraps and the through-hole 122 through which the coarse filter 140 passes. The fine filter 120 may be substantially horizontally mounted on the drainage hole 50 of the bottom plate 35 of the wash tub 30. The fine filter 120 may have a slope so that the wash water can be guided toward the through-hole 122 by its self-load. The wash water of the wash tub 30 may flow toward the coarse filter 140 along the slope of the fine filter 120. However, some of the wash water and scraps may pass through the filter unit 121 of the fine filter 120 and directly flow into the water retaining chamber 110 of the sump 100.

The micro filter 130 may have a filter unit 131 that filters relatively small-sized or larger scraps and has a flat shape, frames 132, 133, and 135 that support the filter unit 131, and the through-hole 139 through which the coarse filter 140 passes.

The frames 132, 133, and 135 include an upper frame 132, a lower frame 133, and side frames 135. The micro filter 135 may be mounted on the sump 100 such that the lower frame 133 adheres to the bottom portion 101 of the sump 100 and the side frames 135 adhere to the side wall portion 103 of the sump 100. The micro filter 130 may divide the water retaining chamber 110 of the sump 100 into the scrap collecting chamber 111 and a circulation chamber 112. The drainage pump 52 is connected to the scrap collecting chamber 111, and the circulation pump 51 is connected to the circulation chamber 112.

When the lower portion of the coarse filter 140 is provided to protrude toward the scrap collecting chamber 111, the wash water that passes through the coarse filter 140 and scraps contained in the wash water may be introduced into the scrap collecting chamber 111. The wash water introduced into the scrap collecting chamber 111 may pass through the micro filter 130 and flow into the circulation chamber 112. In this case, since the scraps contained in the wash water introduced into the scrap collecting chamber 111 cannot pass through the micro filter 130, the scraps remain in the scrap collecting chamber 111 as they are without flowing into the circulation chamber 112. The scraps collected in the scrap collecting chamber 111 may be discharged to the outside of the main body 10 together with the wash water when the drainage pump 52 is operated.

The coarse filter 140 may be vertically inserted downward into the sump 100 and then mounted on the sump 100 by being rotated from an unlocking position to a locking position. According to an embodiment, the coarse filter 140 may be mounted on the sump 100 by a mounting protrusion formed at an outer circumferential surface of the coarse filter 140 and a mounting groove into which the mounting protrusion is horizontally inserted when the coarse filter 140 is rotated from the unlocking position to the locking position formed at the inner surface of the side wall portion 103 of the sump 100.

The circulation pump 51 may pump the wash water retained in the circulation chamber 112 and transfer the wash water to each of the nozzles 311, 313, and 320 of the spray nozzle assembly 300. A wash water spray pressure of each of the nozzles 311, 313, and 320 may change according to a transfer force of the circulation pump 51. In other words, the wash water spray pressure of each of the nozzles 311, 313, and 320 may increase as the transfer force of the circulation pump 51 is larger, and conversely, the wash water spray pressure of each of the nozzles 311, 313, and 320 may also decreased when the transfer force of the circulation pump 51 is smaller. The circulation pump 51 may include an inverter and a motor. The circulation pump 51 may obtain the transfer force by a driving force of the motor. The motor of the circulation pump 51 may be a brushless direct current (BLDC) motor. The transfer force of the circulation pump 51 may change when the revolutions per minute (RPM) of the BLDC motor changes, and the wash water spray pressure of each of the nozzles 311, 313, and 320 may also change according to the change of the transfer force of the circulation pump 51.

Figure 9:
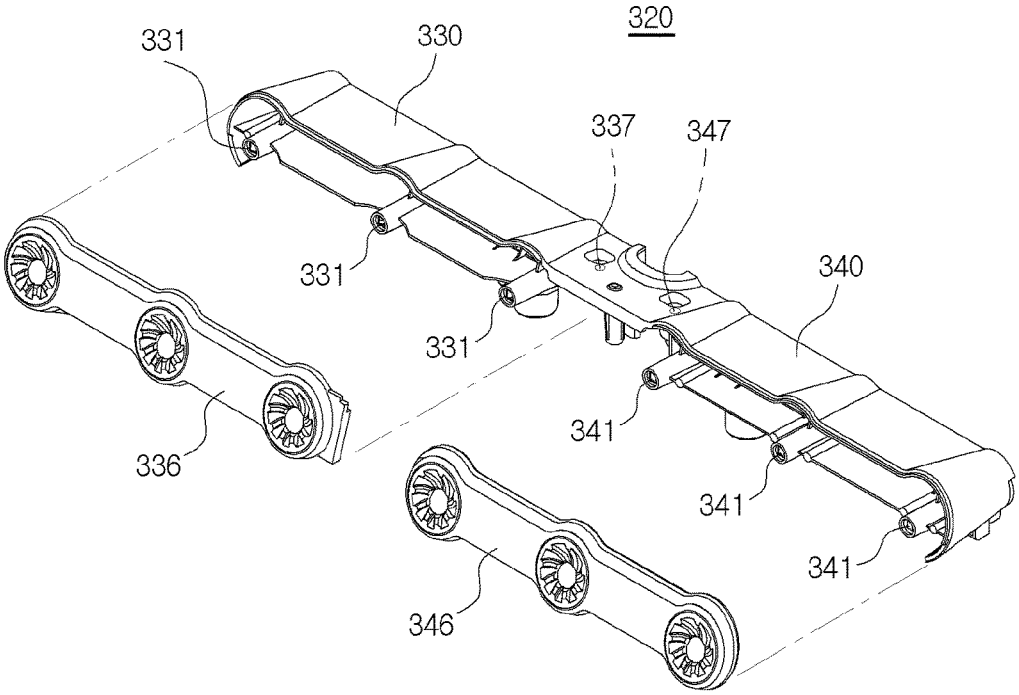
FIG. 9 is a perspective view of a first embodiment of a fixed spray nozzle assembly of the dishwasher.
Figure 10:
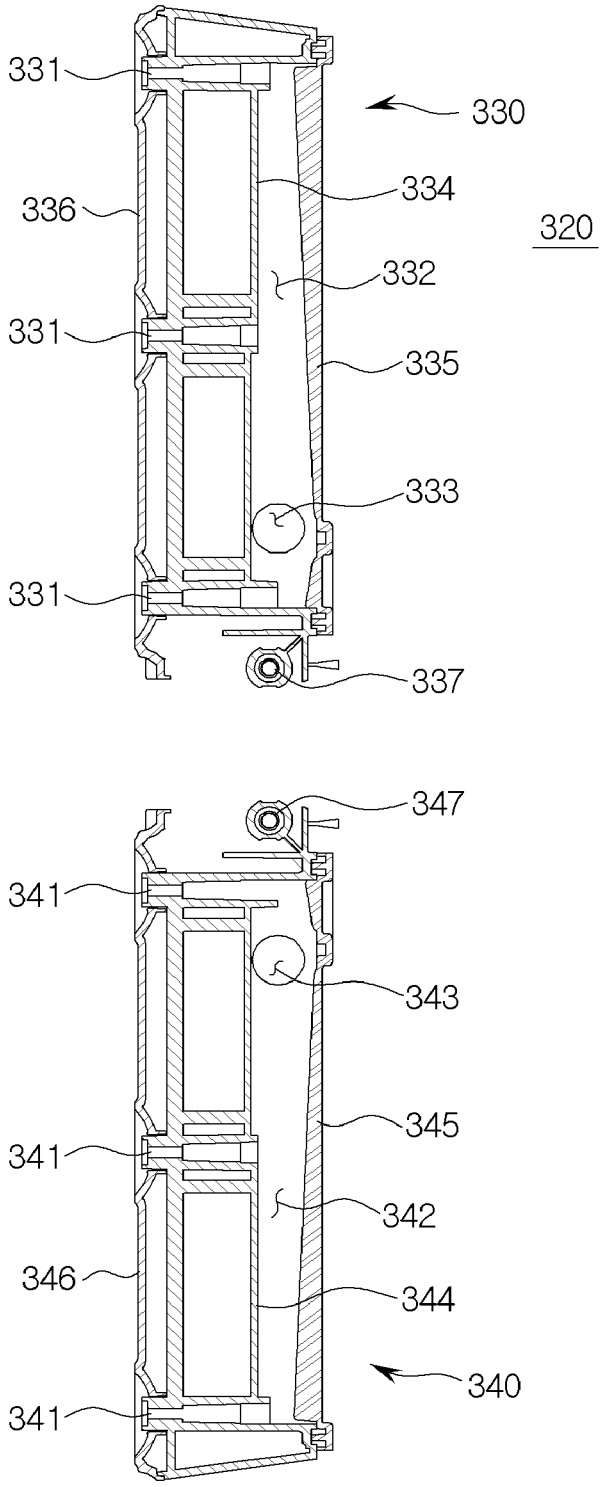
FIG. 10 is a cross-sectional view of the first embodiment of the fixed spray nozzle assembly of the dishwasher.

FIG. 9 is a perspective view of a first embodiment of a fixed spray nozzle assembly of the dishwasher, and FIG. 10 is a cross-sectional view of the first embodiment of the fixed spray nozzle assembly of the dishwasher. As illustrated in FIGS. 9 and 10, the fixed nozzle assembly 320 may include the left fixed nozzle 330 and the right fixed nozzle 340. The left fixed nozzle 330 may include the spray nozzles 331 that spray wash water, a nozzle flow channel 332 that supplies the wash water to the spray nozzles 331, a nozzle inlet 333 through which the wash water is introduced into the nozzle flow channel 332, a nozzle body 334 that forms an exterior, a nozzle cover 335 coupled to the rear of the nozzle body 334 to form the nozzle flow channel 332, an ornamental member 336 coupled to the front of the nozzle body 334, and a coupling hole 337 formed at the nozzle body 334 to couple the left fixed nozzle 330 to a bottom plate cover.

The right fixed nozzle 340 may include the spray nozzles 341 that spray wash water, a nozzle flow channel 342 that supplies the wash water to the spray nozzles 341, a nozzle inlet 343 through which the wash water is introduced into the nozzle flow channel 342, a nozzle body 344 that forms an exterior, a nozzle cover 345 coupled to the rear of the nozzle body 344 to form the nozzle flow channel 342, an ornamental member 346 coupled to the front of the nozzle body 344, and a coupling hole 347 formed at the nozzle body

344 to couple the right fixed nozzle 340 to a bottom plate cover 600. Here, the nozzle body 334 of the left fixed nozzle 330 and the nozzle body 344 of the right fixed nozzle 340 may be integrally formed. In this way, by the left fixed nozzle 330 and the right fixed nozzle 340 being integrally provided, it may be easy to horizontally align the left fixed nozzle 330 and the right fixed nozzle 340, and it may be easy to couple the right fixed nozzle 340 to the bottom plate cover 600.

Figure 11:
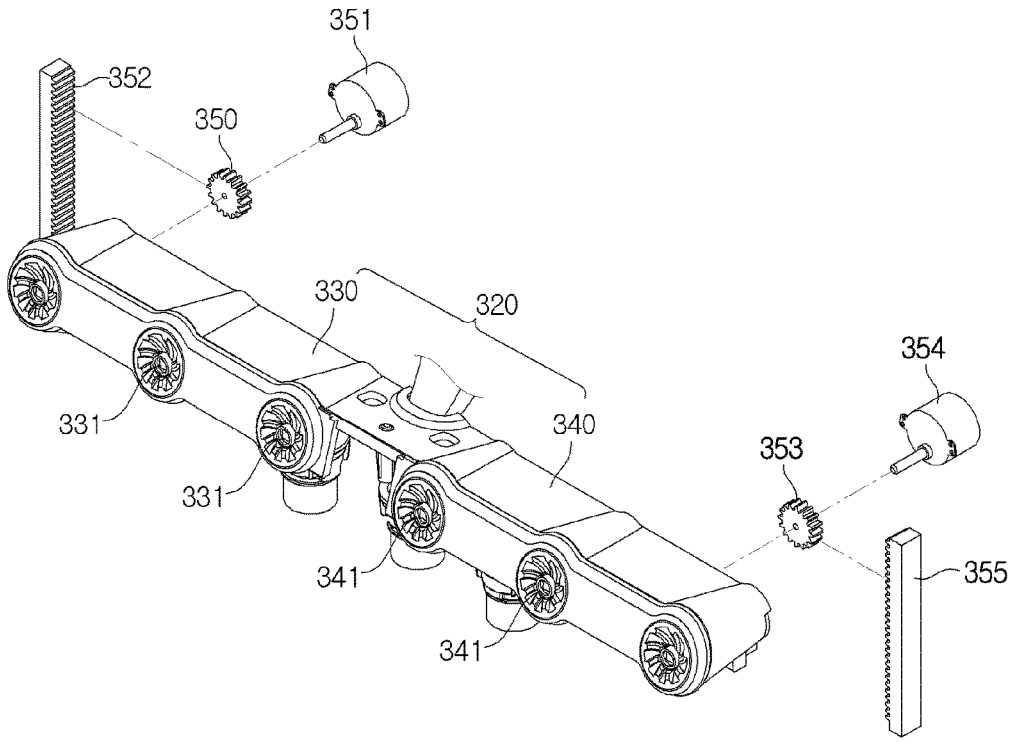
FIG. 11 is a perspective view of a second embodiment of a fixed spray nozzle assembly of the dishwasher.
Figure 12:
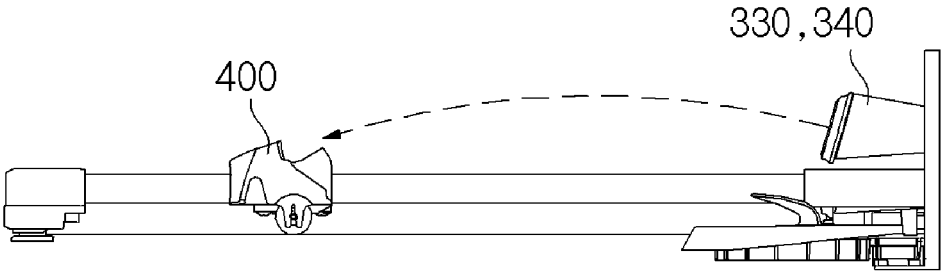
FIGS. 12 and 13 are views for describing an operation of the second embodiment of the fixed spray nozzle assembly of the dishwasher.
Figure 13:
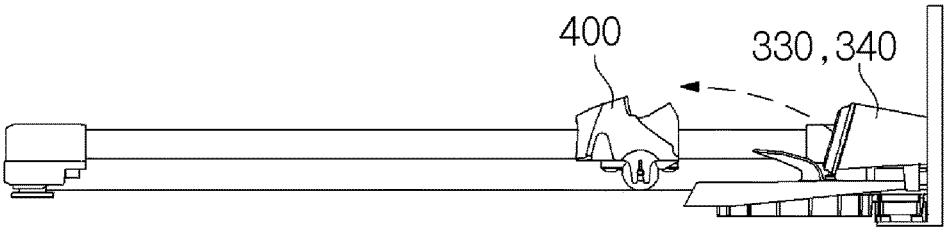

FIG. 11 is a perspective view of a second embodiment of a fixed spray nozzle assembly of the dishwasher, and FIGS. 12 and 13 are views for describing an operation of the second embodiment of the fixed spray nozzle assembly of the dishwasher.

The nozzles 330 and 340 of the fixed spray nozzle assembly 320 may move in vertical directions. According to an embodiment, as illustrated in FIG. 11, the fixed spray nozzle assembly 320 may include toothed wheels 350 and 353, guide bars 352 and 355 having second teeth interlocked to first teeth formed on at least one surface thereof, and motors 351 and 354 that rotate the toothed wheels 350 and 353. The toothed wheels 350 and 353 may be rotatably connected to housings of the nozzles 330 and 340. When the motors 351 and 354 operate, the toothed wheels 350 and 353 may rotate along rotational directions of the motors 351 and 354 and move along the interlocked guide bars 352 and 355. The nozzles 330 and 340 connected to the toothed wheels 350 and 353 may also move along the guide bars 352 and 355 as the toothed wheels 350 and 353 move along the guide bars 352 and 355. Consequently, the nozzles 330 and 340 of the fixed spray nozzle assembly 320 may move in the vertical directions.

The nozzles 330 and 340 may move in the upper direction when the reflecting module 400 is far apart from the nozzles 330 and 340 as illustrated in FIG. 12. Consequently, even when there is a long distance between the reflecting module 400 and the nozzles 330 and 340, the wash water sprayed by the nozzles 330 and 340 may stably reach and be reflected by the reflecting module 400. Meanwhile, conversely, the nozzles 330 and 340 may move in the lower direction when the reflecting module 400 is located in a local area from the nozzles 330 and 340 as illustrated in FIG. 13. As a result, the wash water may stably reach and be reflected also by the reflecting module 400 located in the local area.

Figure 14:
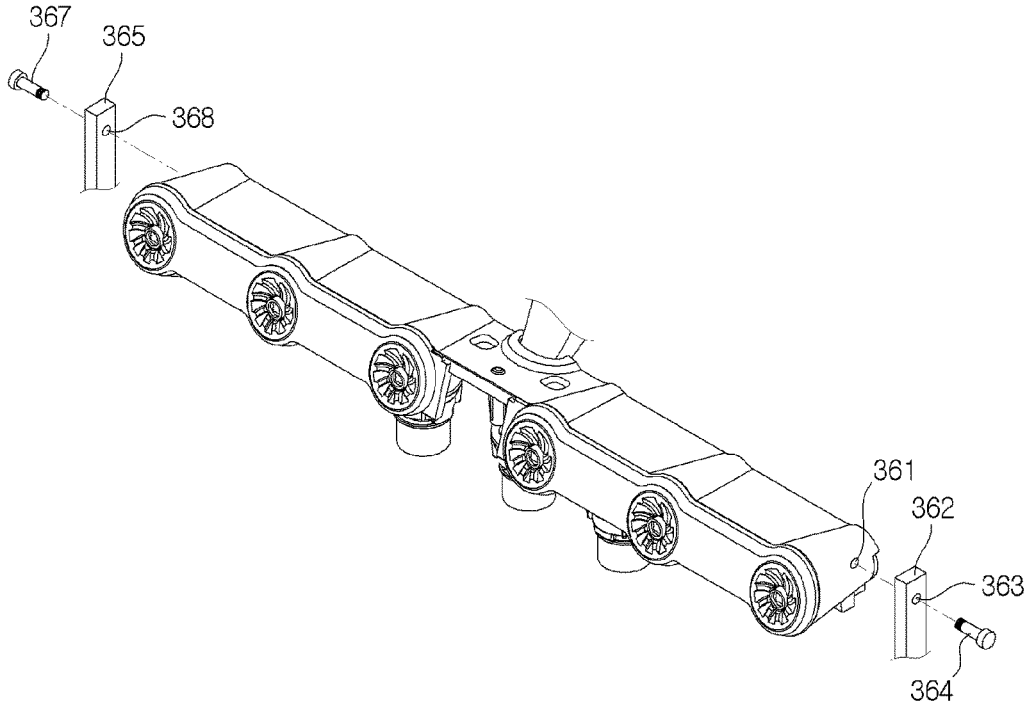
FIG. 14 is a perspective view of a third embodiment of a fixed spray nozzle assembly of the dishwasher.
Figure 15:
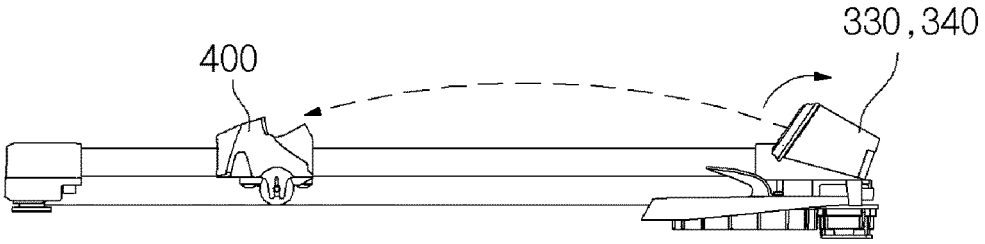
FIGS. 15 and 16 are views for describing a first operation of the third embodiment of the fixed spray nozzle assembly of the dishwasher.
Figure 16:
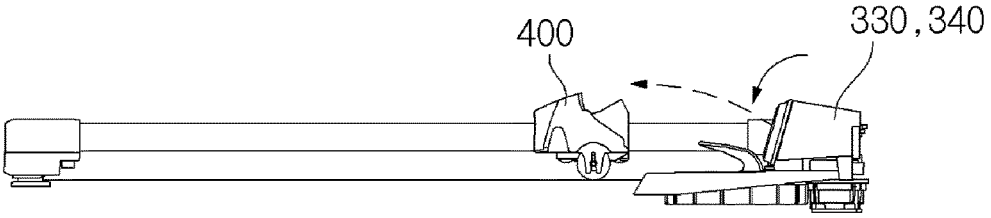

FIG. 14 is a perspective view of a third embodiment of a fixed spray nozzle assembly of the dishwasher, and FIGS. 15 and 16 are views for describing a first operation of the third embodiment of the fixed spray nozzle assembly of the dishwasher.

Spray angles of the nozzles 330 and 340 of the fixed spray nozzle assembly 320 may be adjusted. To adjust the spray angles, the fixed spray nozzle assembly 320 may include a first insertion groove 361, support bars 362 and 365, second insertion grooves 363 and 366, and fastening members 364 and 367. The first insertion groove 361 may be formed at outer surfaces of housings of the nozzles 330 and 340. The support bars 362 and 365 may be fixed to a part of the bottom plate 35 of the wash tub 30 of the dishwasher 1. The second insertion grooves 363 and 366 may be formed by passing through the support bars 362 and 365. The fastening members 364 and 367 may sequentially pass through the second insertion grooves 363 and 366 and the first insertion groove 361 to connect the nozzles 330 and 340 to the support bars 362 and 365. The nozzles 330 and 340 may be rotated about the fastening members 364 and 367. In other words, the nozzles 330 and 340 may rotate about the first insertion groove 361 or the second insertion grooves 363 and 366. According to an embodiment, the nozzles 330 and 340 may be rotated in the upper direction or the lower direction using a motor and the like connected to the fastening members 364 and 367. According to another embodiment, the nozzles 330 and 340 may also be rotated in the upper direction or the lower direction by a reaction force of a spray force with which the wash water is sprayed or a reaction force generated as the wash water reaches the reflecting module 400.

The nozzles 330 and 340 may rotate in the upper direction by a power device such as a motor when the reflecting module 400 is far from the nozzles 330 and 340 as illustrated in FIG. 15. Consequently, even when there is a long distance between the reflecting module 400 and the nozzles 330 and 340, the wash water sprayed by the nozzles 330 and 340 may stably reach and be reflected by the reflecting module 400. Meanwhile, conversely, when the reflecting module 400 is located in a local area from the nozzles 330 and 340 as illustrated in FIG. 16, the nozzles 330 and 340 may rotate in the lower direction by the power device such as a motor. Consequently, even when the reflecting module 400 is located in the local area, the wash water may be stably reflected by the reflecting module 400.

Figure 17:
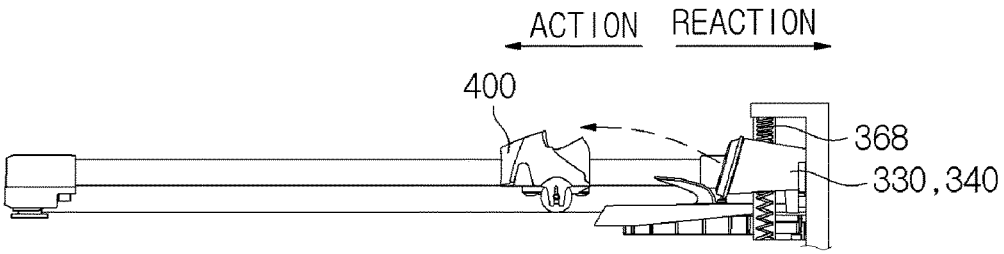
FIGS. 17 and 18 are views for describing a second operation of the third embodiment of the fixed spray nozzle assembly of the dishwasher.
Figure 18:
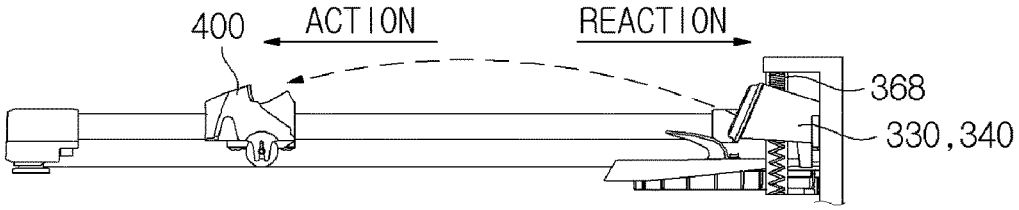

FIGS. 17 and 18 are views for describing a second operation of the third embodiment of the fixed spray nozzle assembly of the dishwasher. When the reflecting module 400 is located in the local area from the nozzles 330 and 340 as illustrated in FIG. 17, a strong reaction force may be applied to the nozzles 330 and 340, and the nozzles 330 and 340 may rotate according to the reaction force applied thereto. According to an embodiment, an elastic body 368 such as a spring may be provided at the nozzles 330 and 340 so that the nozzles 330 and 340 are rotatable in a desired direction according to the reaction force. For example, as illustrated in FIG. 17, the elastic body 368 may be provided at the nozzles 330 and 340 so that the nozzles 330 and 340 rotate in the lower direction. Conversely, when the reflecting module 400 is far from the nozzles 330 and 340 as illustrated in FIG. 18, a weak reaction force may be applied to the nozzles 330 and 340. In this case, positions of the nozzles 330 and 340 may be restored according to an elastic force of the elastic body 368 such as a spring. In other words, the nozzles 330 and 340 may rotate in the opposite direction from the case in which the reflecting module 400 is located in the local area.

Figure 19:
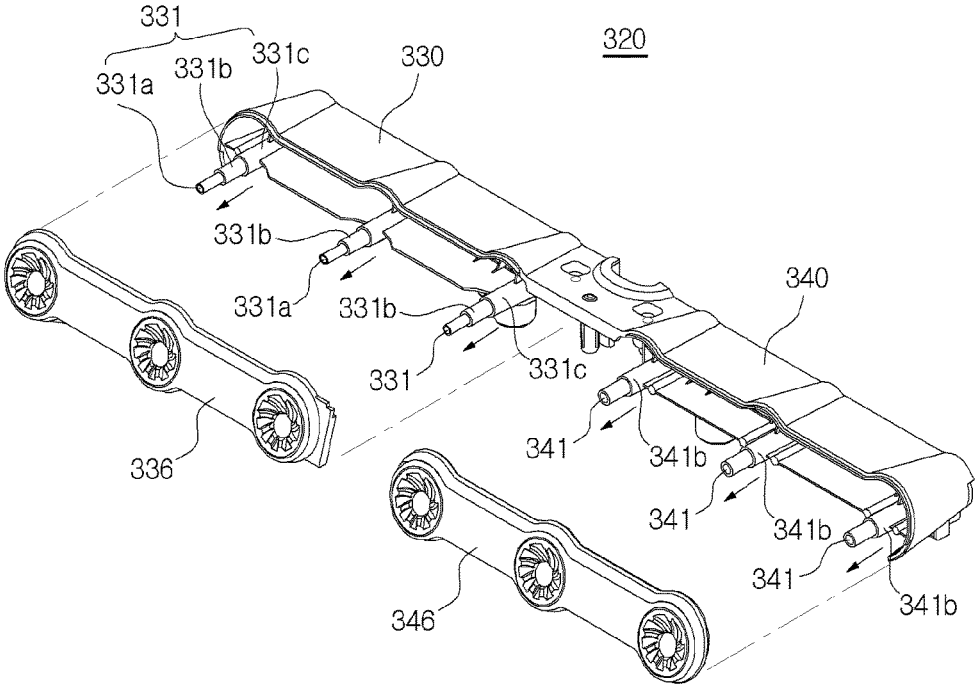
FIG. 19 is a perspective view of a fourth embodiment of a fixed spray nozzle assembly of the dishwasher.
Figure 20:
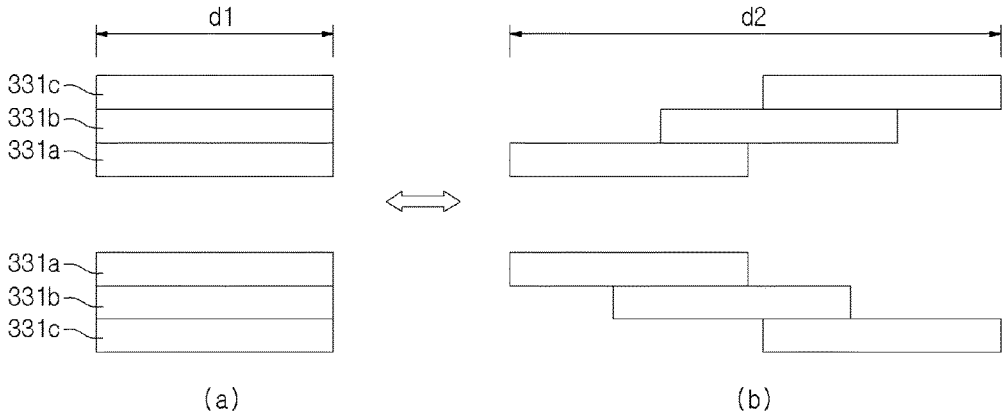
FIG. 20 is a cross-sectional view of the fourth embodiment of the fixed spray nozzle assembly of the dishwasher.
Figure 21:
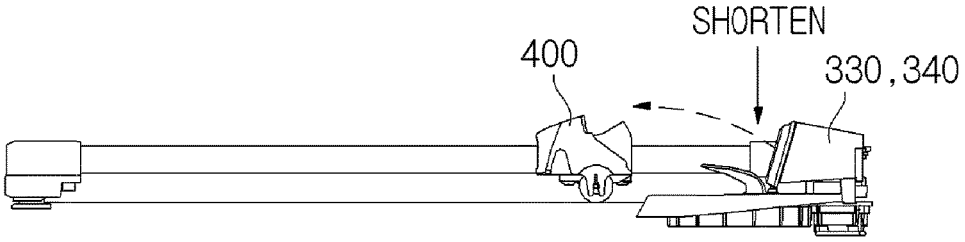
FIGS. 21 and 22 are views for describing an operation of the fourth embodiment of the fixed spray nozzle assembly of the dishwasher.
Figure 22:
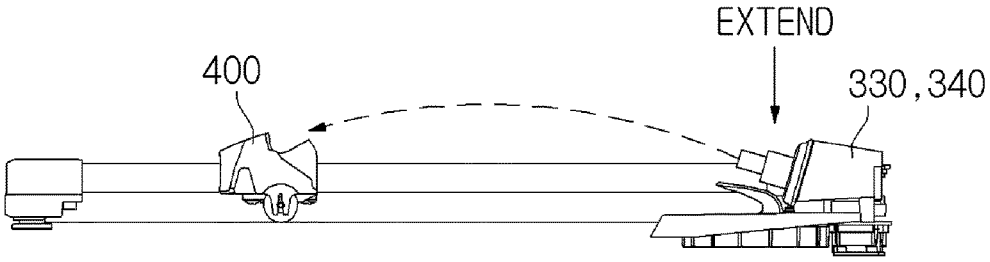

FIG. 19 is a perspective view of a fourth embodiment of a fixed spray nozzle assembly of the dishwasher, FIG. 20 is a cross-sectional view of the fourth embodiment of the fixed spray nozzle assembly of the dishwasher, and FIGS. 21 and 22 are views for describing an operation of the fourth embodiment of the fixed spray nozzle assembly of the dishwasher.

A length of the spray nozzles 331 and 341 of the fixed spray nozzle assembly 320 may be extended or shortened. Referring to what is illustrated in FIGS. 19 and 20, the spray nozzles 331 and 341 may include a first spray nozzle unit 331*a*, a second spray nozzle unit 331*b*, and a third spray nozzle unit 331*c* different from each other. The first spray nozzle unit 331*a* may move from the inside of the second spray nozzle unit 331*b* and protrude toward the outside as illustrated in FIG. 20. The second spray nozzle unit 331*b* may move from the inside of the third spray nozzle unit 331*c* and protrude toward the outside. When the first spray nozzle unit 331*a* and the second spray nozzle unit 331*b* respectively protrude from the second spray nozzle unit 331*b* and the third spray nozzle unit 331*c*, the length of the spray nozzles 331 and 341 may be changed from a first length d1 to a second length d2. In other words, the length of the spray nozzles 331 and 341 may be extended. Conversely, when the first spray nozzle unit 331*a* and the second spray nozzle unit 331*b* are respectively inserted into the second spray nozzle unit 331*b* and the third spray nozzle unit 331*c*, the length of the spray nozzles 331 and 341 may be changed from the second length d2 to the first length d1. Consequently, the length of the spray nozzles 331 and 341 may be shortened.

When the length of the spray nozzles 331 and 341 is extended, effects in which the linearity of a spray path of the wash water is secured and the wash water sprayed by the nozzles 330 and 340 moves to a farther distance can be obtained. Consequently, as illustrated in FIGS. 21 and 22, the length of the spray nozzles 331 and 341 may be shortened when the reflecting module 400 is near the nozzles 330 and 340 and the length of the spray nozzles 331 and 341 may be extended when the reflecting module 400 is far from the nozzles 330 and 340 to allow the sprayed wash water to stably reach and be reflected by the reflecting module 400.

Figure 23:
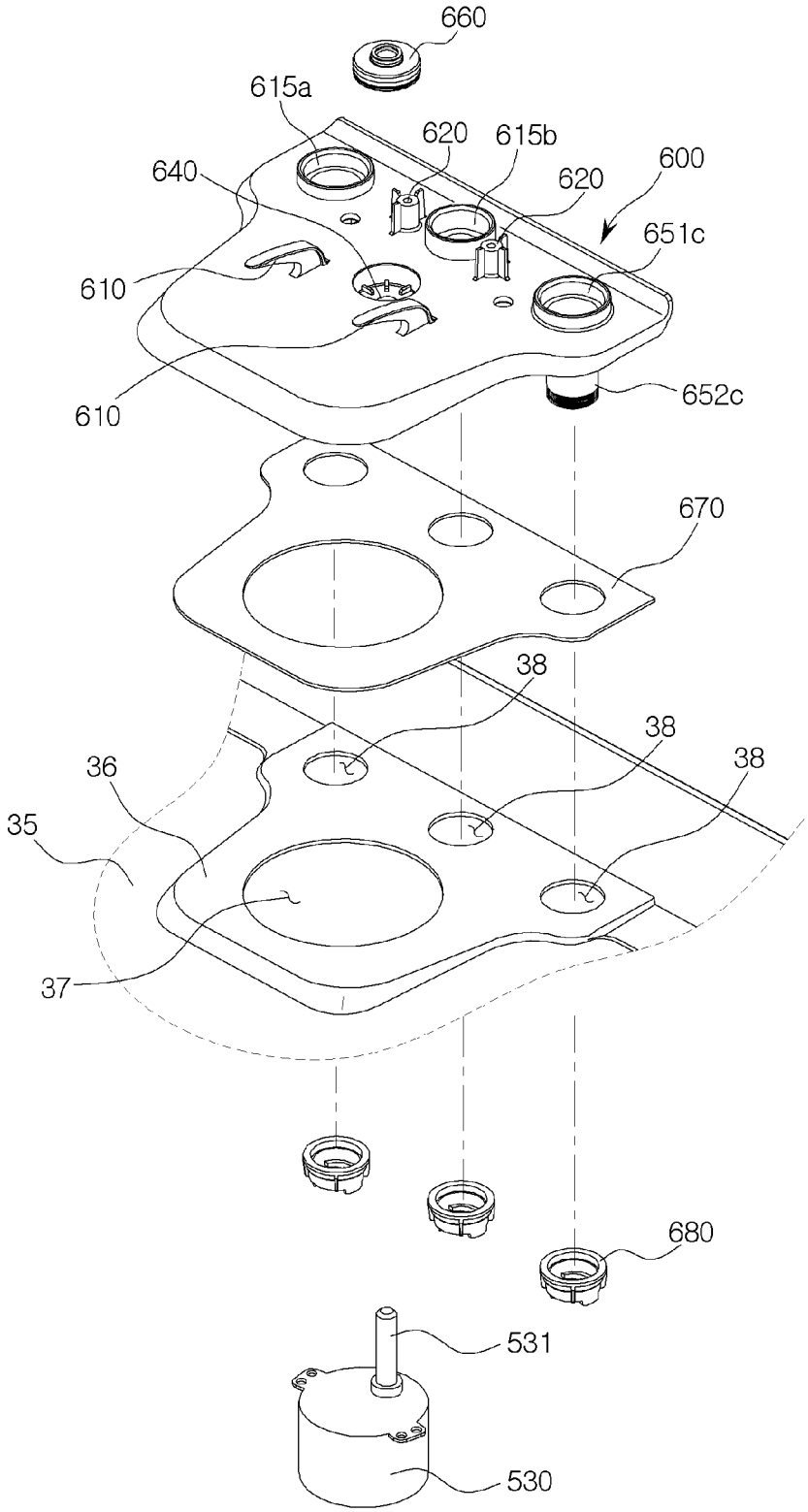
FIG. 23 is an exploded view of a bottom plate, a bottom plate cover, and a motor of a wash tub of the dishwasher.
Figure 24:
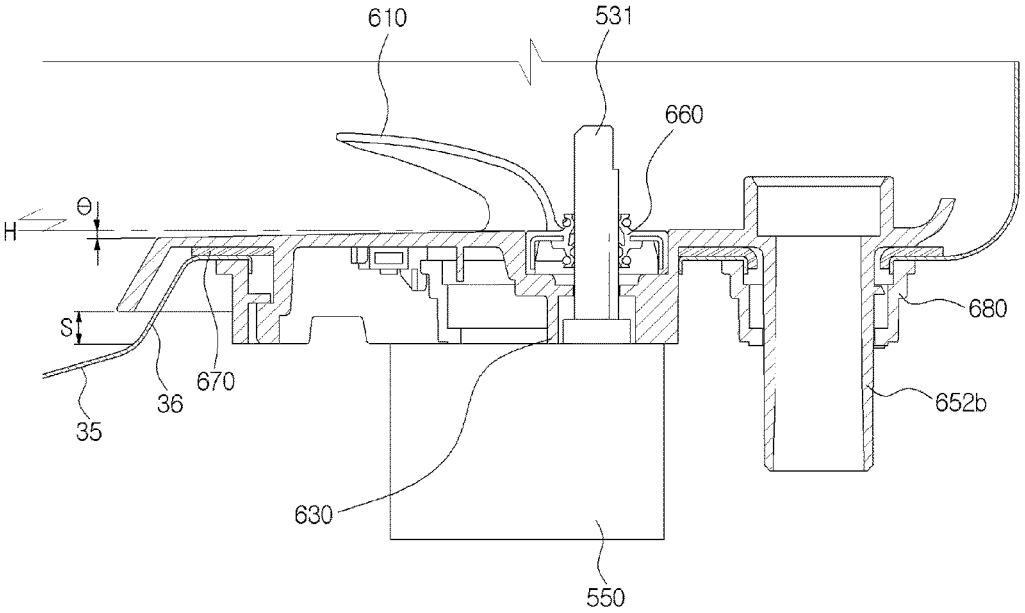
FIG. 24 is a cross-sectional view of the bottom plate, the bottom plate cover, and the motor of the dishwasher.
Figure 25:
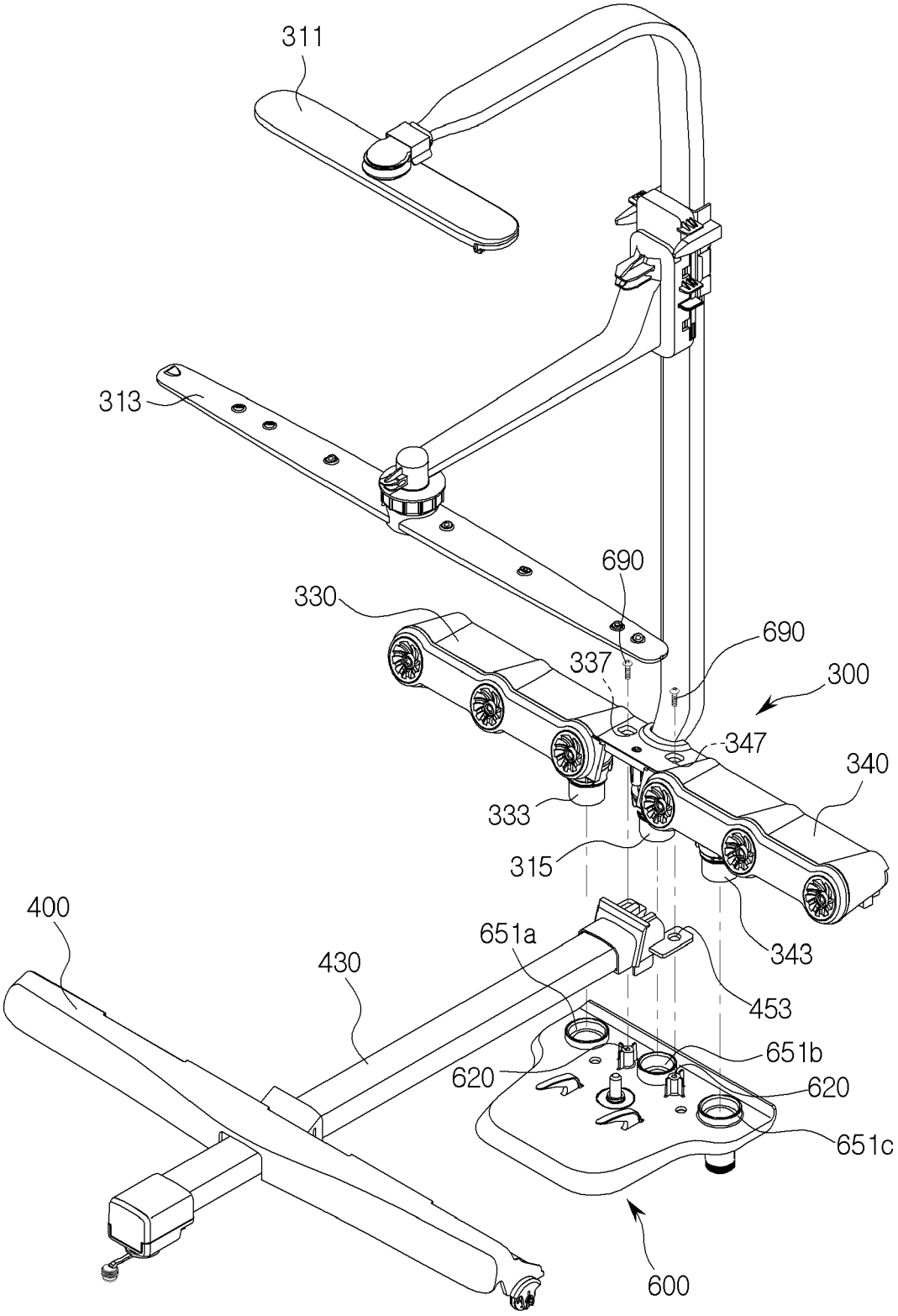
FIG. 25 is an exploded view of a reflecting module, a rail assembly, a spray nozzle assembly, and the bottom plate cover of the dishwasher.

Referring to FIGS. 23 to 25, a bottom plate cover of the dishwasher according to the embodiment of the present disclosure will be described. FIG. 23 is an exploded view of a bottom plate, a bottom plate cover, and a motor of a wash tub of the dishwasher, FIG. 24 is a cross-sectional view of the bottom plate, the bottom plate cover, and the motor of the dishwasher, and FIG. 25 is an exploded view of a reflecting module, a rail assembly, a spray nozzle assembly, and the bottom plate cover of the dishwasher.

The dishwasher 1 may include the bottom plate cover 600 coupled to one rear side of the bottom plate 35 of the wash tub 30. The bottom plate cover 600 performs a role of sealing a motor through-hole 37 and flow channel through-holes 38, a role of supporting a motor 530 that drives the reflecting module 400, and a role of fixing a rail assembly 430 of the dishwasher 1 and the nozzle assembly 300. Here, as mentioned above, the nozzle assembly 300 includes the upper rotary nozzle assembly 311, the middle rotary nozzle 313, the left fixed nozzle 330, and the right fixed nozzle 340.

A bottom plate protruding portion 36 protruding so that the bottom plate cover 600 is coupled thereto may be formed at the rear of the bottom plate 35. The motor through-hole 37, through which the motor 530 for driving the reflecting module 400 passes, and the flow channel through-holes 38, through which a flow channel that connects the nozzle assembly 300 to the distribution device 200 passes, may be formed at the bottom plate protruding portion 36. The motor 530 may be mounted on an undersurface of the bottom plate cover 600, and the motor 530 may be withdrawn together with the bottom plate cover 600 through the motor through-hole 37 when the bottom plate cover 600 is detached from the bottom plate 35. Hose connection units 652*a*, 652*b*, and 652*c* of the bottom plate cover 600 may specifically pass through the flow channel through-holes 38.

The bottom plate cover 600 may include a shaft through-hole 640 through which a drive shaft 531 of the motor 530 passes, the hose connection units 652*a*, 652*b*, and 652*c* that protrude downward so that hoses 271*a*, 271*b*, and 271*c* extended from the distribution device 200 are coupled thereto and are inserted into the flow channel through-holes 38 of the bottom plate protruding portion 36, nozzle inlet connection units 651*a*, 651*b*, and 651*c* that protrude upward so that inlets 333, 343 of the nozzle assembly 300 are coupled thereto, fastening holes 620 for fixing the nozzle assembly 300 and the rail assembly 430, and a rotation guide 610 that protrudes to guide rotation of the reflecting module 400.

The bottom plate cover 600 is adhered and coupled to an upper surface of the bottom plate protruding portion 36. Fixing caps 680 are coupled to the hose connection units 652*a*, 652*b*, and 652*c* of the bottom plate cover 600 so that the bottom plate cover 600 may be fixed to the bottom plate protruding portion 36.

The motor through-hole 37 of the bottom plate protruding portion 36 and a sealing member 670 that prevents the wash water inside the wash tub 30 from leaking through the flow channel through-holes 38 may be provided between the bottom plate cover 600 and the bottom plate protruding portion 36.

A motor mounting unit 630 on which the motor 530 that drives the reflecting module 400 is mounted may be provided at the undersurface of the bottom plate cover 600. The drive shaft 531 of the motor 530 may pass through the shaft through-hole 640 of the bottom plate cover 600 and protrude toward the inside of the wash tub 30. A drive pulley 500 may be coupled to the drive shaft 531 of the motor 530 and rotate together with the drive shaft 531. A sealing member 660 may be provided at the shaft through-hole 640 so that the wash water inside the wash tub 30 does not leak through the shaft through-hole 640. The sealing member 660 may be a mechanical sealing device that allows smooth rotation of the driving shaft 531 and performs sealing.

An upper surface of the bottom plate cover 600 may be provided to be inclined at a predetermined angle with respect to a reference horizontal surface. This is to prevent scraps from accumulating on the bottom plate cover 600 or advancing toward the fixed spray nozzles 330 and 340. In the dishwasher 1 according to the embodiment of the present disclosure, since the fixed spray nozzles 330 and 340 do not move unlike the rotary nozzles 311 and 313 and thus scraps may remain and be stuck therein, such a problem may be prevented by the structure above. An angle of inclination between the upper surface of the bottom plate cover 600 and the reference horizontal surface is preferably approximately 3° or larger.

In addition, an end portion of the bottom plate cover 600 may be prevented to be spaced apart from the bottom plate 35 by a predetermined interval. This is because it is difficult to make the bottom plate cover 600 and the bottom plate 35 completely adhere to each other due to an error in manufacturing and assembling, and this is rather to prevent scraps from being struck in fine gaps formed between the end portion of the bottom plate cover 600 and the bottom plate 35. An interval S between the end portion of the bottom plate cover 600 and the bottom plate 35 is preferably approximately 5 mm or larger.

The rail assembly 430 and the nozzle assembly 300 may be coupled to the bottom plate cover 600. The bottom plate cover 600, the rail assembly 430, and the nozzle assembly 300 may be firmly fixed by a fastening member 690. For this, fastening holes 620, 453, and 347 may be respectively formed at corresponding positions of the bottom plate cover 600, the nozzle assembly 300, and the rail assembly 430. Accordingly, the rail assembly 430 and the nozzle assembly 300 may be fixed to each other and aligned with each other.

Figure 26:
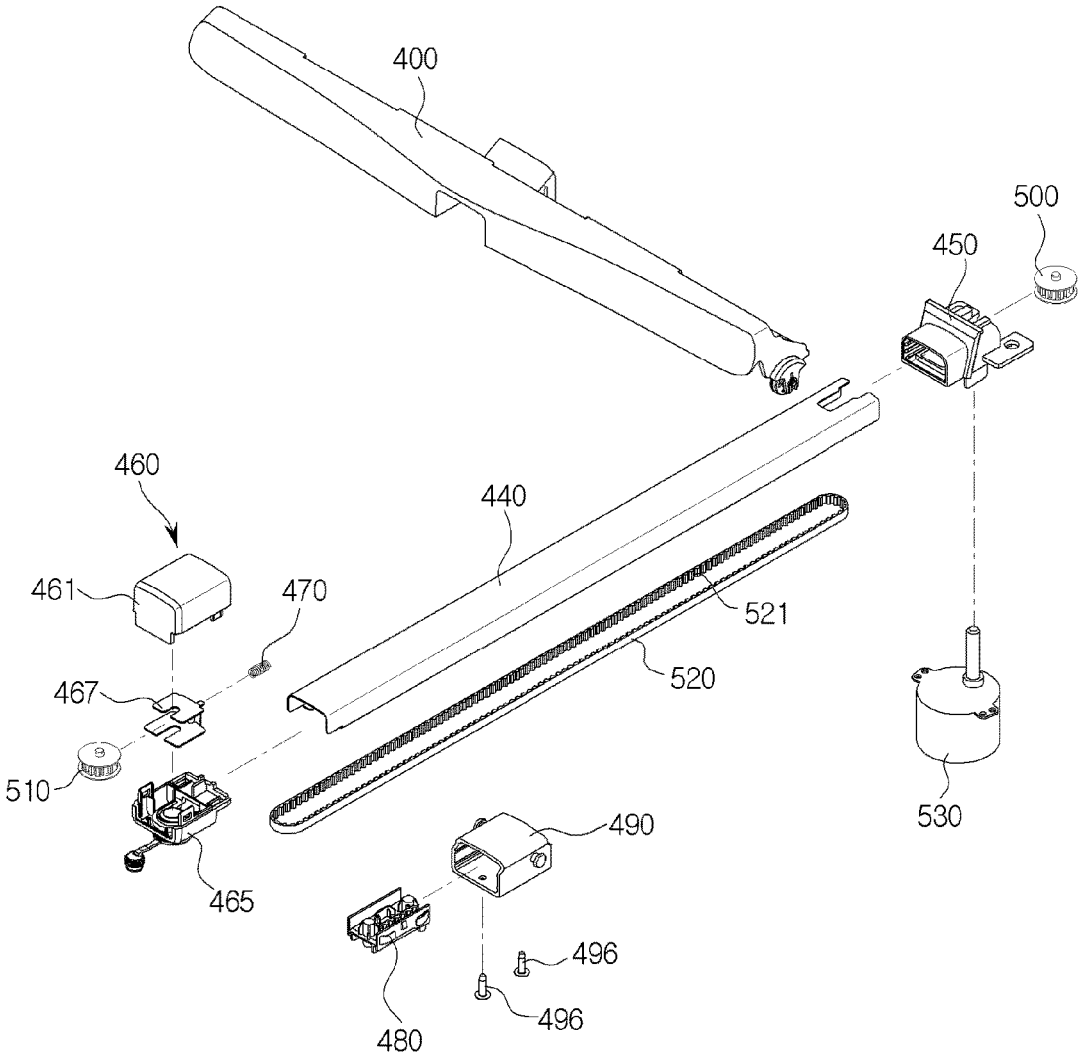
FIG. 26 is an exploded view of a first embodiment of the reflecting module and the rail assembly.
Figure 27:
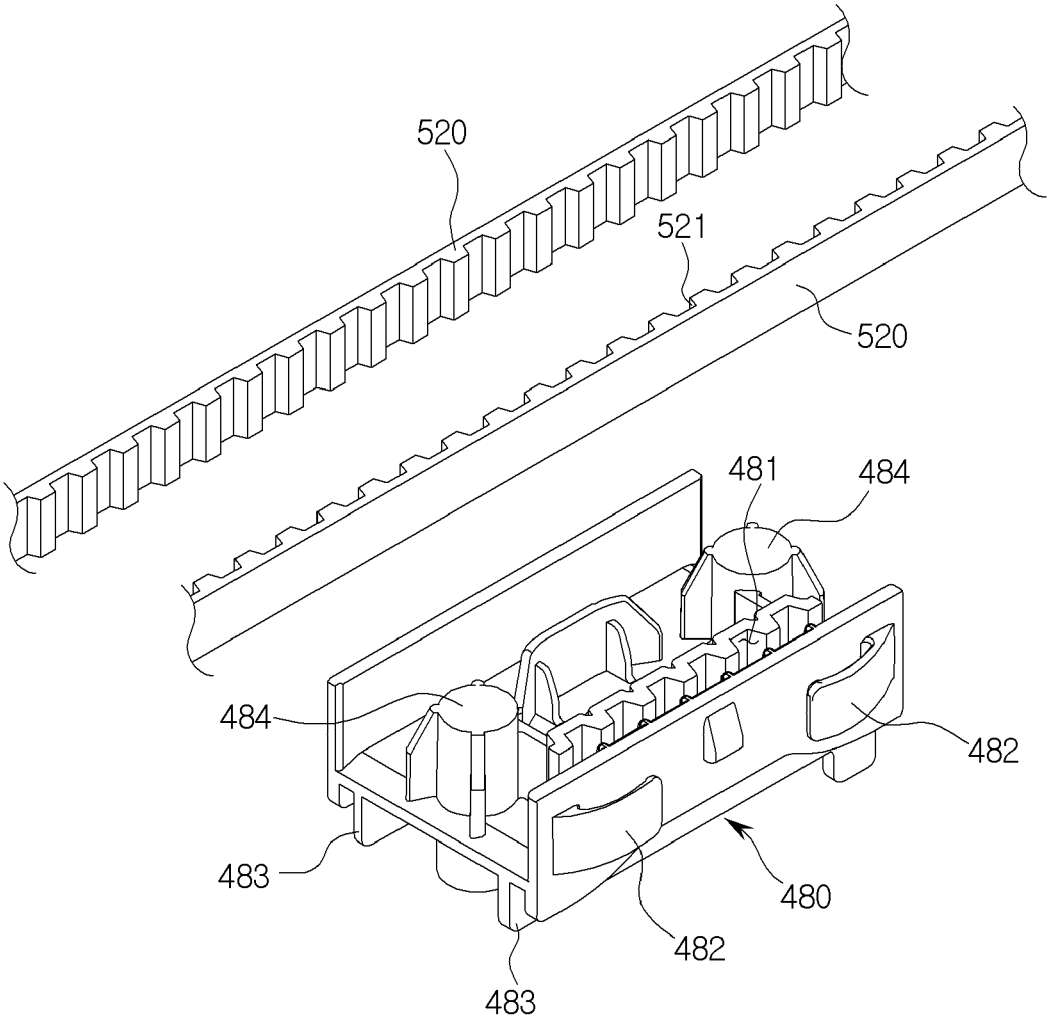
FIG. 27 is a view illustrating a rail, a belt, a drive pulley, and a rear holder of the first embodiment of the rail assembly.
Figure 28:
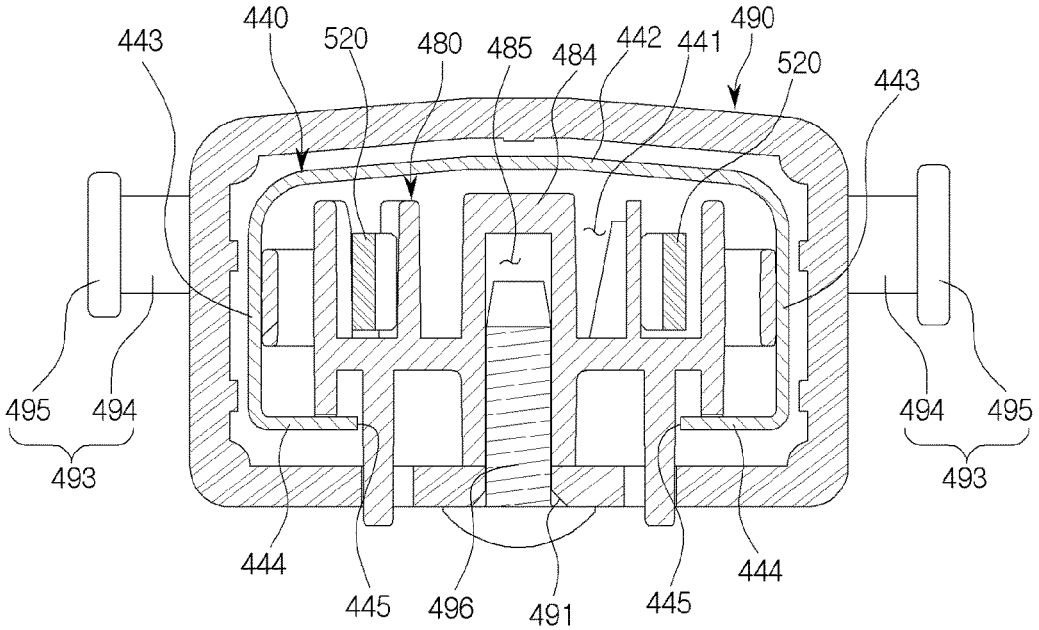
FIG. 28 is a cross-sectional view of the rail, the belt, the drive pulley, and the rear holder of the first embodiment of the rail assembly.
Figure 29:
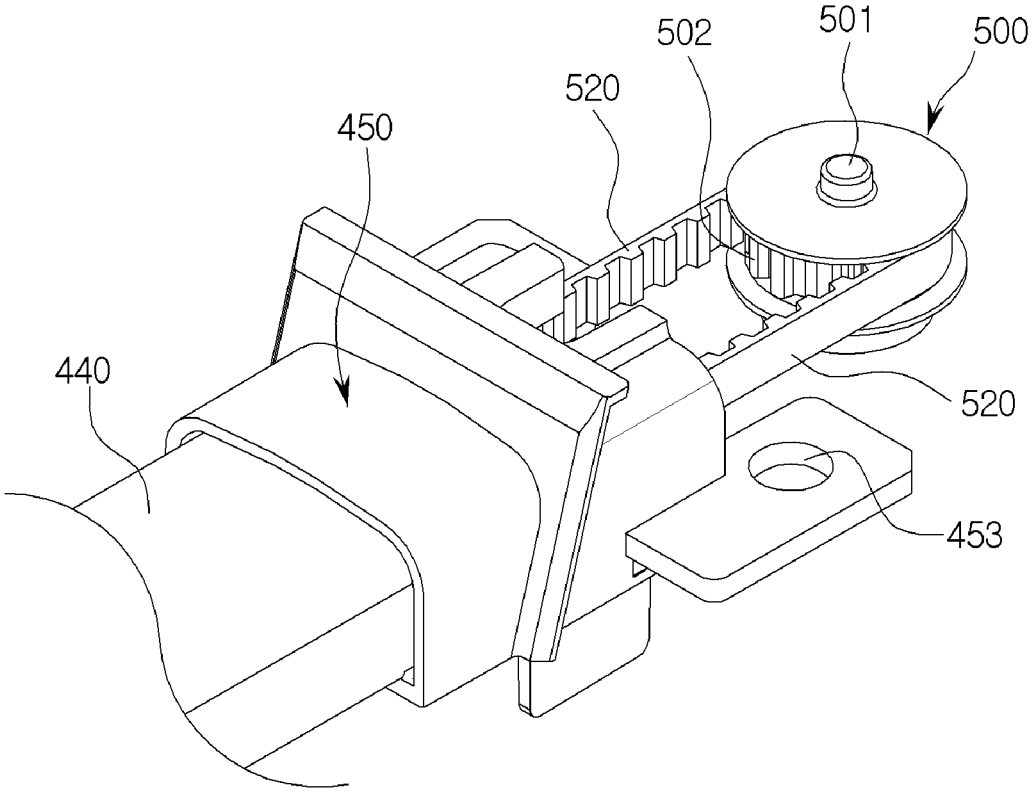
FIG. 29 is a view illustrating the rail, the belt, an idle pulley, and a front holder of the first embodiment of the rail assembly.
Figure 30:
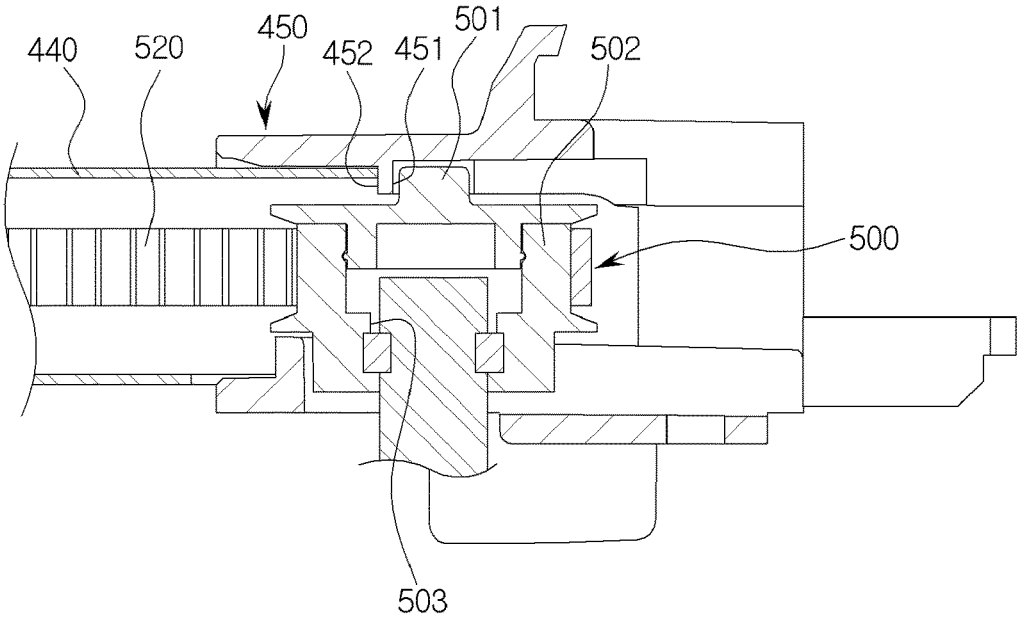
FIG. 30 is a cross-sectional view of the rail, the belt, the idle pulley, and the front holder of the first embodiment of the rail assembly.
Figure 31:
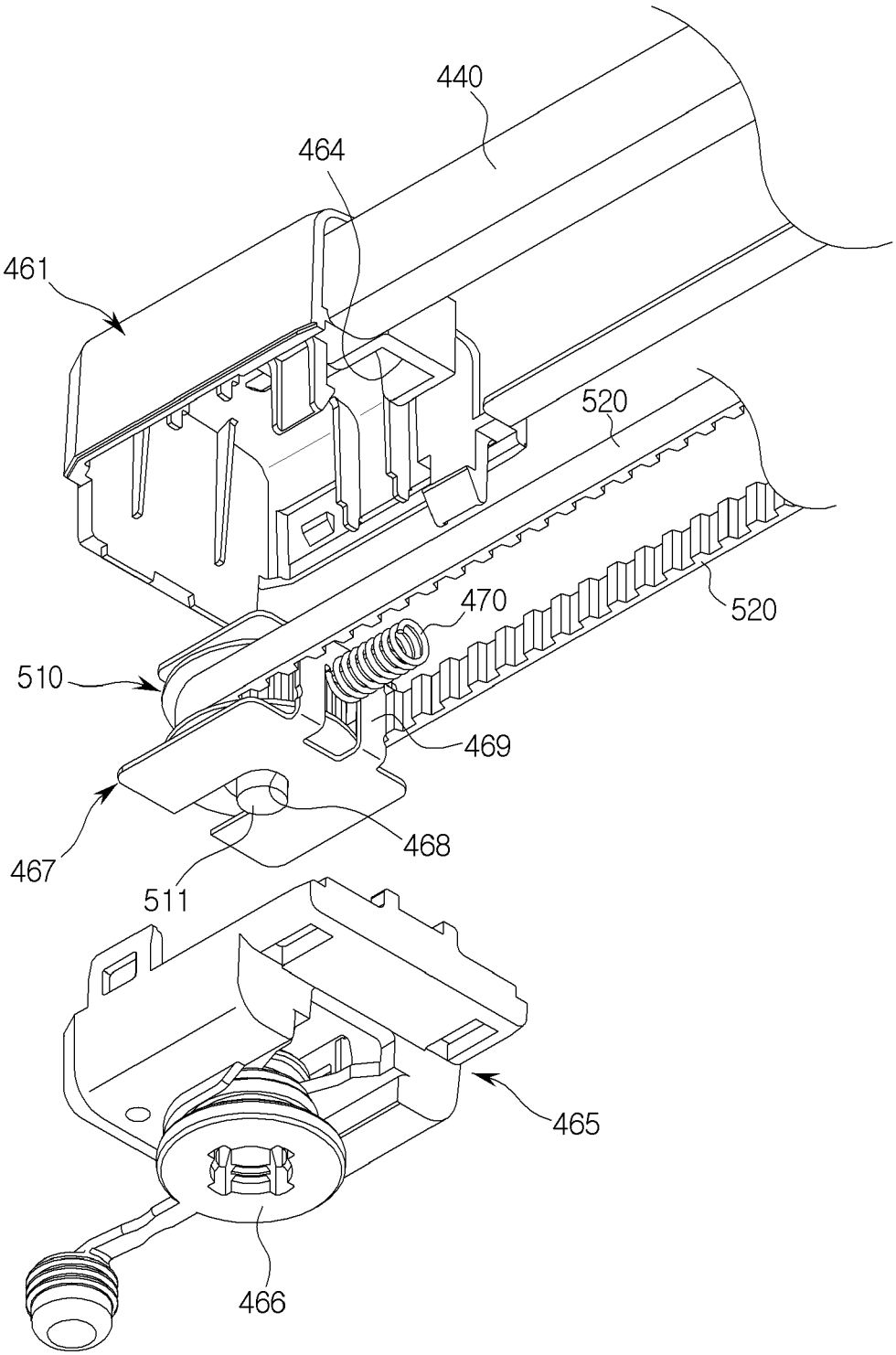
FIG. 31 is a view illustrating a belt and a belt holder of a moving module.
Figure 32:
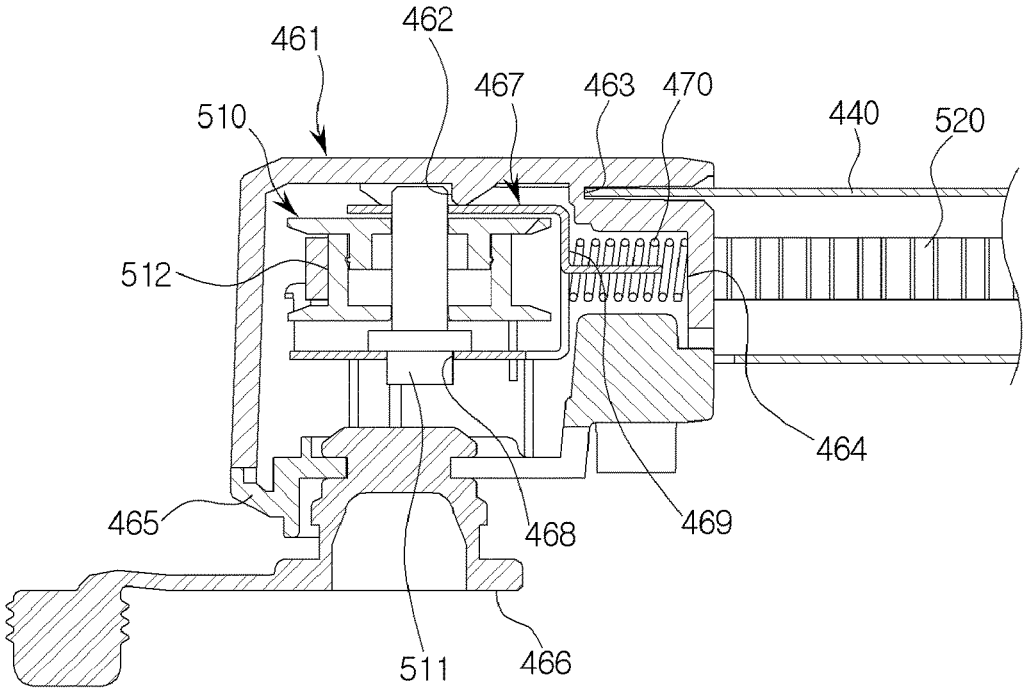
FIG. 32 is a lateral cross-sectional view of an embodiment of the moving module.

FIG. 26 is an exploded view of a first embodiment of the reflecting module and the rail assembly, and FIG. 27 is a view illustrating a rail, a belt, a drive pulley, and a rear holder of the first embodiment of the rail assembly. FIG. 28 is a cross-sectional view of the rail, the belt, the drive pulley, and the rear holder of the first embodiment of the rail assembly, and FIG. 29 is a view illustrating the rail, the belt, an idle pulley, and a front holder of the first embodiment of the rail assembly. FIG. 30 is a cross-sectional view of the rail, the belt, the idle pulley, and the front holder of the first embodiment of the rail assembly, and FIG. 31 is a view illustrating a belt and a belt holder of a moving module. FIG. 32 is a lateral cross-sectional view of an embodiment of the moving module.

Hereinafter, the reflecting module and a moving module thereof of the dishwasher will be described with reference to FIGS. 21 to 27. The dishwasher 1 includes the reflecting module 400 that reflects the wash water sprayed from the fixed nozzles 330 and 340. The reflecting module 400 may linearly reciprocate along a spray direction of the wash water sprayed by the fixed nozzles 330 and 340. The dishwasher 1 may include a moving module 420 that moves the reflecting module 400. The moving module 420 may include the motor 530 that generates a driving force and the rail assembly 430 that guide movement of the reflecting module 400.

The rail assembly 430 may include a rail 440 that guides movement of the reflecting module 400 and has an inner space 441, the drive pulley 500 that rotates by being connected to the motor 530, a belt 520 that rotates by being connected to the drive pulley 500 and is disposed in the inner space 441 of the rail 440, an idle pulley 510 connected to the belt 520 to rotatably support the belt 520, a belt holder 480 disposed in the inner space 441 of the rail 440 to be coupled to the belt 520 to linearly reciprocate, a reflecting module holder 490 disposed outside the rail 440 to be coupled to the belt holder 480 to linearly reciprocate and to which the reflecting module 400 is coupled, a rear holder 450 that rotatably supports the drive pulley 500 and is coupled to a rear end portion of the rail 440, and a front holder 460 that rotatably supports the idle pulley 510 and is coupled to a front end portion of the rail 440.

The rail 440 may be formed with a metal material. The rail 440 may be provided to longitudinally extend in front and rear directions at the center with respect to the left wall 33 and the right wall 34 of the wash tub 30. The rail 440 may have a pipe shape in which an opening 445 is formed at an approximately lower portion. That is, the rail 440 may include the inner space 441, an upper wall 442, a lower wall 444, both side walls 443, and the lower opening 445 formed on the lower wall 444. The lower opening 445 may extend from one end portion to the other end portion in a longitudinal direction of the rail 440. By this structure, an operation of the belt 520 being interfered with due to coming into contact with dishes in the wash tub 30 or the belt 520 being corroded due to coming into contact with the wash water in the wash tub 30 may be prevented.

The belt 520 forms a closed loop by being wound around the drive pulley 500 and the idle pulley 510 and may rotate along a rotational direction of the motor 530 when the motor 530 operates. The belt 520 may be formed of a resin material including aramid fibers in consideration of tensile strength, cost, etc. A toothed form 521 that transmits a driving force of the belt 520 to the belt holder 480 may be formed at an inner surface of the belt 520. The belt holder 480 may be disposed in the inner space 441 of the rail 440 like the belt 520, and may be coupled to the toothed form 521 of the belt 520 and rotate together with the belt 520. For this, the belt holder 480 may have a toothed form coupling portion 481 coupled to the toothed form 521 of the belt 520. In addition, the belt holder 480 may include legs 482 and 483 supported by the rail 440. The legs 482 and 483 may include one or more side legs 482 that protrude sideward to be supported by the side walls 443 of the rail 440 and at least one or more lower legs 483 that protrude downward to be supported by the lower wall 444 of the rail 440. The side legs 482 may be provided to be elastically deformable to reduce noise and vibration due to collision and friction with the rail 440 when the belt holder 480 moves and to allow the belt holder 480 to smoothly move. The side legs 482 may be an elastic body of one type of a plate spring. That is, the side legs 482 may include a curved plate that is elastically deformed between a stretched shape and a compressed shape. In addition, the belt holder 480 may have a fastening unit 484 for coupling with the reflecting module holder 490. The fastening unit 484 may include a fastening hole 485 into which a fastening member 496 is inserted.

The reflecting module holder 490 is coupled to the belt holder 480 to move together with the belt holder 480 and transmits the driving force of the belt holder 480 to the reflecting module 400. The reflecting module holder 490 is provided to surround an outer surface of the rail 440. The reflecting module holder 490 is coupled to the belt holder 480 through the lower opening 445 of the rail 440. For this, the reflecting module holder 490 may have a fastening hole 491 for coupling with the belt holder 480. Consequently, by fastening the fastening member 496 to the fastening hole 491 of the reflecting module holder 490 and the fastening hole 485 of the belt holder 480, the reflecting module holder 490 and the belt holder 480 may be coupled to each other. The fastening member 496 advances from bottom to top and may be sequentially fastened to the fastening hole 491 of the reflecting module holder 490 and the fastening hole 485 of the belt holder 480. A coupling protrusion unit 493 to which the reflecting module 400 is detachably coupled may be formed at the reflecting module holder 490. The coupling protrusion unit 493 may include a coupling shaft part 494 that protrudes sideward and a deviation prevention part 495 formed at an end portion of the coupling shaft part 494 to prevent the deviation of the reflecting module 400.

The drive pulley 500 may include a rotary shaft 501, a shaft connection unit 503 connected to the drive shaft 530 of the motor 530 to receive a driving force, and a belt coupling unit 502 to which the belt 520 is coupled.

The rear holder 450 rotatably supports the drive pulley 500 and is coupled to the rear end portion of the rail 440. The rear holder 450 includes a pulley support surface 451 that supports the rotary shaft 501 of the drive pulley 500, a rail support surface 452 that supports the rear end portion of the rail 440, and the fastening hole 453 for being coupled to the bottom plate cover 600.

The idle pulley 510 may include a rotary shaft 511 and a belt coupling unit 512 to which the belt 520 is coupled.

The front holder 460 may include a front top holder 461, a front bottom holder 465 coupled to a lower portion of the front top holder 461, and a pulley bracket 467 that is movably provided along the longitudinal direction of the rail 440 between the front top holder 461 and the front bottom holder 465 and rotatably supports the idle pulley 510. The front top holder 461 may include a pulley support surface 462 that supports the rotary shaft 511 of the idle pulley 510 and a rail support surface 463 that supports the front end portion of the rail 440.

The front bottom holder 465 may be coupled to the lower portion of the front top holder 461 by a locking structure. The front bottom holder 465 may have a coupling protrusion 466 coupled to the bottom plate 35 of the wash tub 30.

The pulley bracket 467 includes a pulley support surface 468 that supports the rotary shaft 511 of the idle pulley 510.

The rail 440, the belt 520, the drive pulley 500, the rear holder 450, the idle pulley 510, and the front holder 460 may be assembled to each other by tension of the belt 520. In other words, the drive pulley 500 is pressed in a direction approaching the rail 440 by the tension of the belt 520, and a force is transmitted to the rear holder 450 through the pulley support surface 451 of the rear holder 450 such that the rear holder 450 is adhered and coupled to the rear end portion of the rail 440. In addition, the idle pulley 510 is pressed in a direction approaching the rail 440 by the tension of the belt 520, and a force is transmitted to the front holder 460 through the pulley support surface 462 of the front holder 460 such that the front holder 460 is adhered and coupled to the front end portion of the rail 440. Meanwhile, the front holder 460 may further include an elastic member 470 for maintaining the tension of the belt 520. This is because the belt 520 extends and the tension of the belt 520 is reduced when the belt 520 thermally expands due to hot air inside the wash tub 30, and the reflecting module 400 cannot operate smoothly when the tension of the belt 520 is reduced.

One end portion of the elastic member 470 may be supported by the front holder 460, and the other end portion of the elastic member 470 may be supported by the pulley bracket 467. For this, elastic member support surfaces 464 and 469 may be respectively formed at the front holder 460 and the pulley bracket 467. The elastic member 470 may be a compression spring. Since the front holder 460 is supported by the rail 440 by the rail support surface 463, the elastic force of the elastic member 470 may act on the pulley bracket 467. That is, the pulley bracket 467 may be pressed in a direction away from the rail 440 by the elastic force of the elastic member 470. Here, since the pulley bracket 467 is being pressed in the direction approaching the rail 440 by the tension of the belt 520, the pulley bracket 467 is moved to a position where the tension of the belt 520 and the elastic force of the elastic member 470 form equilibrium. That is, when the tension is reduced due to extension of the belt 520 and the elastic force of the elastic member 470 becomes larger than the tension of the belt 520, the pulley bracket 467 moves in the direction away from the rail 440 by the elastic force of the elastic member 470, and when the pulley bracket 467 moves in the direction away the rail 440, the belt 520 is tightly stretched again and the tension of the belt 520 is restored. By this configuration, even when the belt 520 is extended due to thermal expansion, the tension of the belt 520 may be constantly maintained by the pulley bracket 467 moving and stretching the belt 520, and reliability of the moving module 420 may be improved.

Figure 33:
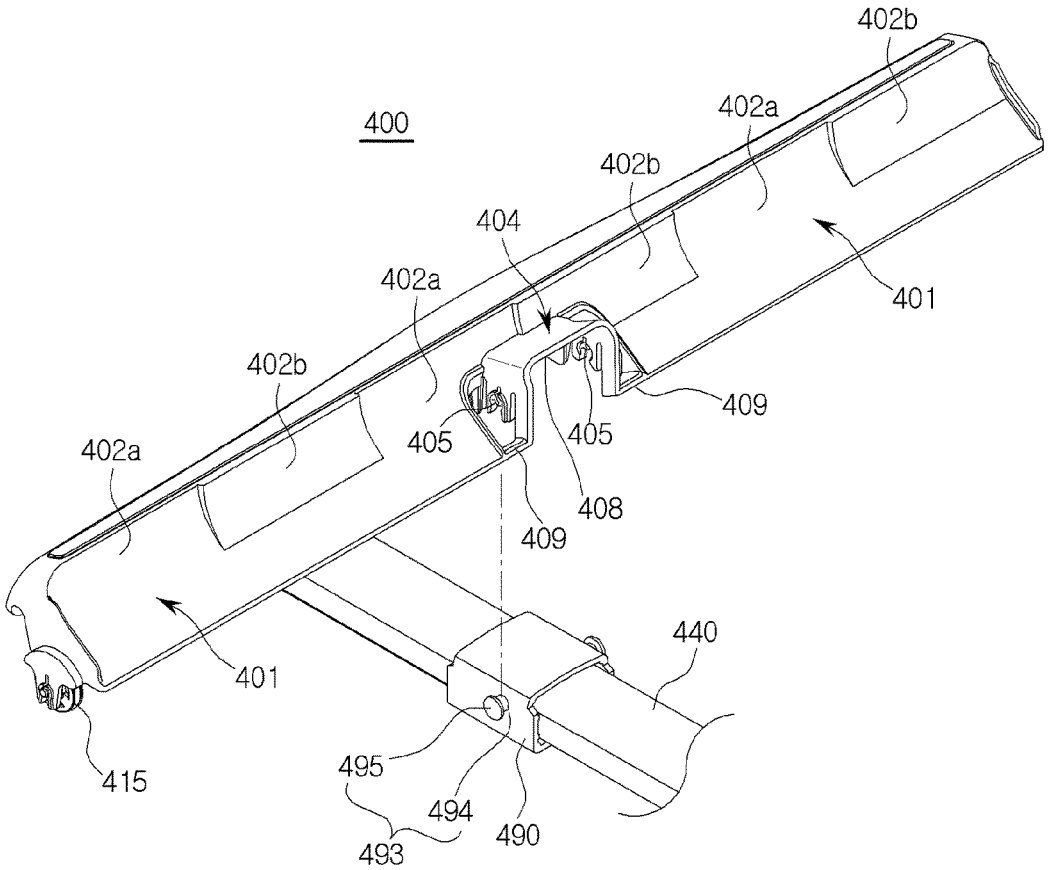
FIG. 33 is a view illustrating an embodiment of the reflecting module and a moving body.
Figure 34:
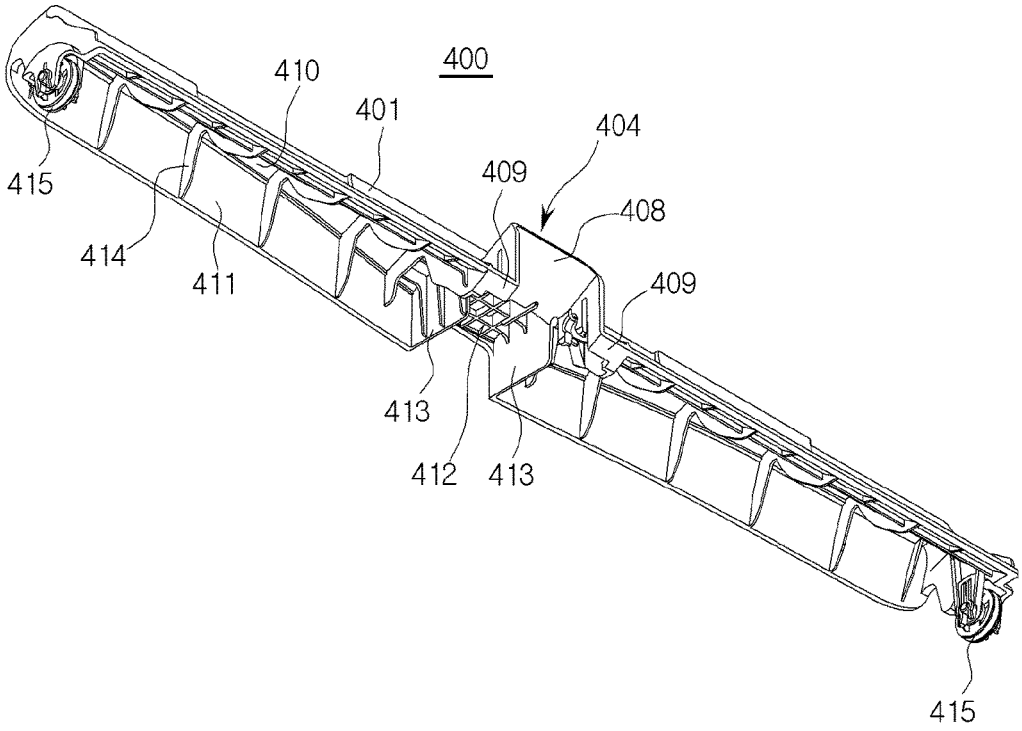
FIG. 34 is a view illustrating a lower surface of the reflecting module.
Figure 35:
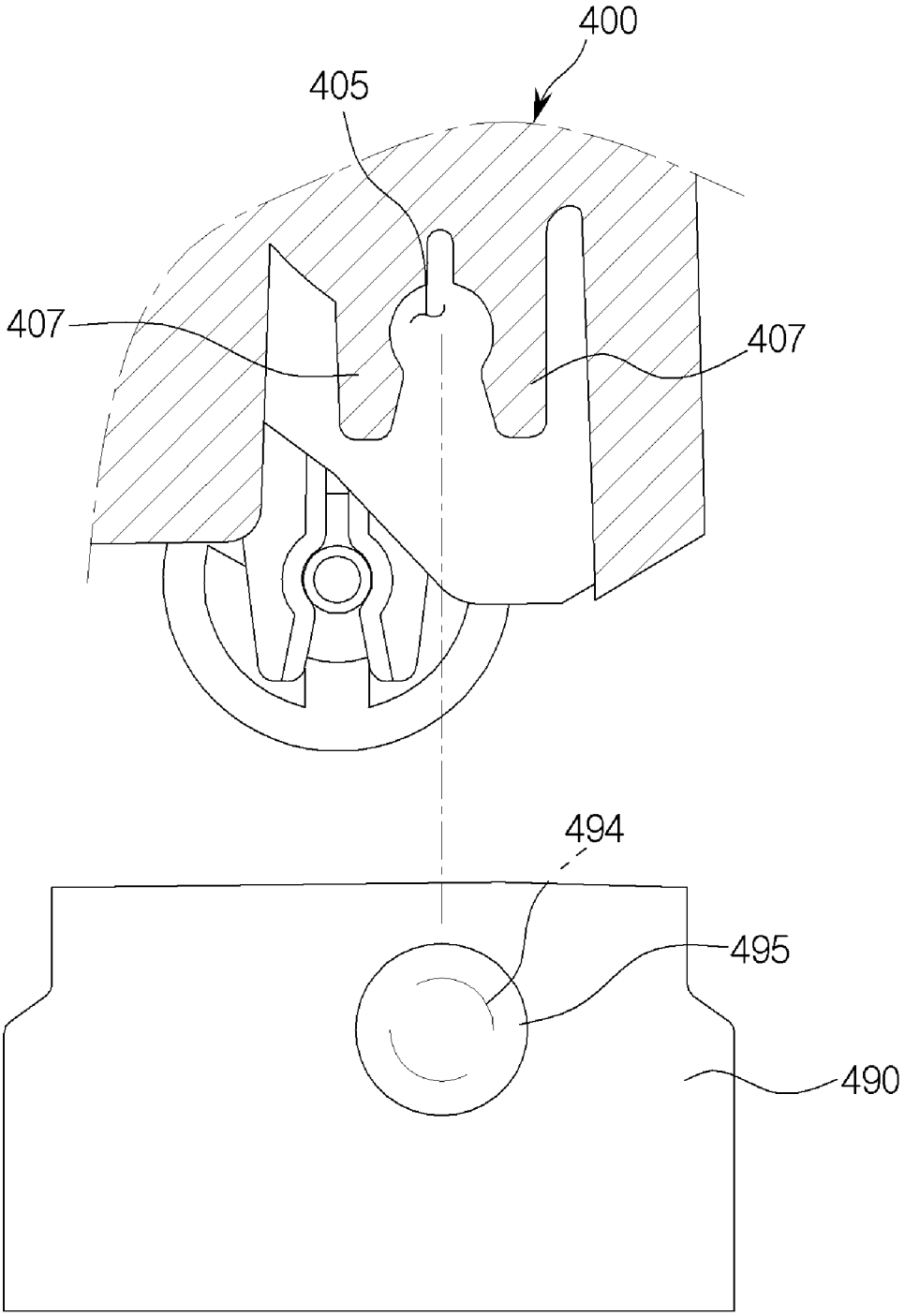
FIG. 35 is a view for describing a coupling between the reflecting module and the moving body.

Hereinafter, the reflecting module according to the embodiment of the present invention will be described with reference to FIGS. 33 to 35. FIG. 33 is a view illustrating an embodiment of the reflecting module and a moving body, and FIG. 34 is a view illustrating a lower surface of the reflecting module. FIG. 35 is a view for describing a coupling between the reflecting module and the moving body.

The reflecting module 400 may be provided to longitudinally extend in a direction perpendicular to the rail 440. The reflecting module 400 may include a reflecting unit 401 that reflects the wash water sprayed by the fixed nozzles 330 and 340, an upper support unit 410 bent from the reflecting unit 401, a rear support unit 411 bent from the upper support unit 410, a cap part 404 provided at a longitudinal central portion of the reflecting unit 401, a rotation locking part 409 provided to interfere with the rotation guide 610 of the bottom plate cover 600, a reinforcing rib 414 provided to reinforce the strength of the upper support unit 410 and the rear support unit 411 of the reflecting unit 401, a horizontal support unit 412 supported by an upper surface of the reflecting module holder 490, and a vertical support unit 413 supported by a side surface of the reflecting module holder 490.

The reflecting unit 401 may include reflecting surfaces 402*a* and 402*b* obliquely provided to reflect the wash water. The reflecting surfaces 402*a* and 402*b* may include a reflecting surface 402*a* and a reflecting surface 402*b* alternately arranged in the longitudinal direction with different slopes to reflect the wash water in different angles. The cap part 404 may include a coupling groove 405 for coupling with the reflecting module holder 490, and a rotation stopper unit 408 that limits a rotation range of the reflecting module 400 when the reflecting module 400 rotates by the rotation guide 610 of the bottom plate cover 600.

The coupling protrusion unit 493 of the reflecting module holder 490 may be coupled to the coupling groove 405 of the reflecting module 400. Specifically, the coupling shaft part 494 of the coupling protrusion unit 493 may be inserted into the coupling groove 405 of the reflecting module 400. The coupling shaft part 494 may rotatably support the reflecting module 400.

As illustrated in FIG. 35, the coupling groove 405 of the reflecting module 400 may be formed by elastic hooks 407. The elastic hooks 407 may be elastically deformed in an opening direction in a process of pushing or withdrawing the coupling shaft part 494 of the reflecting module holder 490 into or from the coupling groove 405 of the reflecting module 400 and may be restored to an original state when the insertion or the detachment is completed. By this configuration, the reflecting module 400 may be mounted on or detached from the reflecting module holder 490.

Rollers 415 that allow smooth movement of the reflecting module 400 may be provided at both longitudinal end portions of the reflecting module 400. A roller support unit 39 that supports the rollers 415 may be provided at the bottom plate 35 of the wash tub 30.

Figure 36:
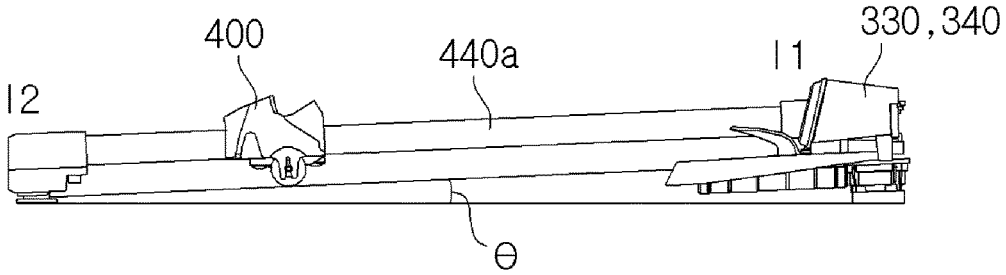
FIG. 36 is a lateral view of a second embodiment of the rail assembly.

FIG. 36 is a lateral view of a second embodiment of the rail assembly. As illustrated in FIG. 36, a rail 440*a* of the rail assembly 430 may be inclined by forming a predetermined angle θ with the bottom plate 35. According to an embodiment, the rail 440*a* may be disposed such that an area I1 adjacent to the nozzles 330 and 340 is high and an opposite direction I2 of the nozzles 330 and 340 is low. The wash water sprayed by the nozzles 330 and 340 may descend due to an influence of gravity. Consequently, when the rail 440*a* is inclined to descend in the opposite direction of the nozzles 330 and 340, the wash water descending due to the influence of gravity may stably reach the reflecting module 400.

Figure 37:
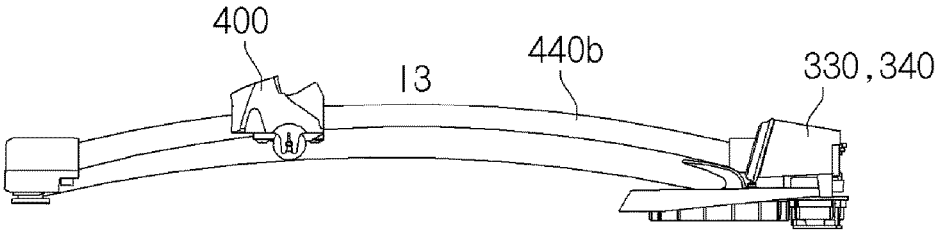
FIG. 37 is a lateral view of a third embodiment of the rail assembly.
Figure 38:
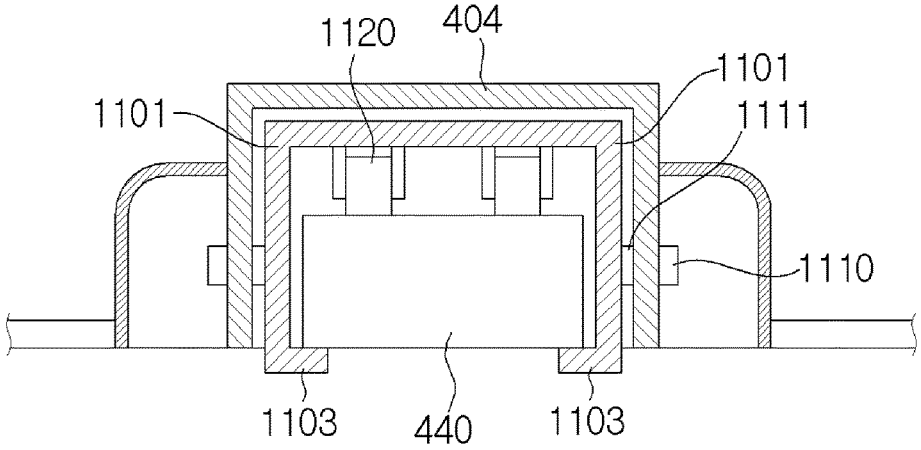
FIG. 38 is a perspective view of a moving body of the third embodiment of the rail assembly.
Figure 39:
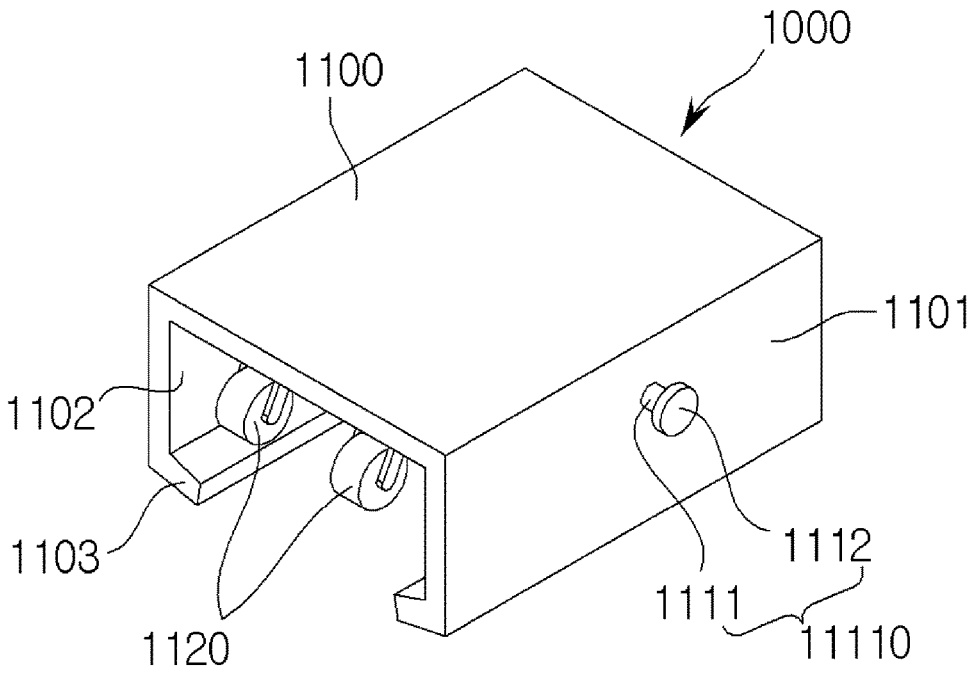
FIG. 39 is a cross-sectional view of the third embodiment of the rail assembly to which the moving body is coupled.

FIG. 37 is a lateral view of a third embodiment of the rail assembly, and FIG. 38 is a perspective view of a moving body of the third embodiment of the rail assembly. FIG. 39 is a cross-sectional view of the third embodiment of the rail assembly to which the moving body is coupled. As illustrated in FIG. 37, a rail 440*b* may be in the shape of a bent curve. According to an embodiment, the rail 440*b* may have a shape in which a central portion 13 convexly protrudes upward. The sprayed wash water moves in a curve inside the wash tub 30 due to influences of gravity and spray force, and the rail 440*b* in the shape of the curve may allow the wash water moving in the curve to stably reach the reflecting module 400.

When the rail 440*b* is in the shape of a curve, a moving body 1000 illustrated in FIGS. 38 and 39 may be provided so that the reflecting module 400 can easily move on the rail 440*b* in the shape of the curve. The moving body 1000 may include a housing 1001 including an upper surface 1100, side surfaces 1101, and 1102, and protrusions 1103, and wheels 1120 provided inside the housing 1001. The protrusions 1103 may protrude inward from lower ends of the side surfaces 1101 and 1102 to prevent the deviation of the rail 440 inserted therein. In addition, a coupling protrusion unit 1110 may be provided to be coupled to the coupling groove 405 of the cap part 404 of the reflecting module 400. The coupling protrusion unit 1110 may include a coupling shaft part 1111 inserted into the coupling groove 405 of the reflecting module 400 and a deviation prevention part 1112 formed at an end portion of the coupling shaft part 1111 to prevent the coupling groove 405 from freely detaching from the coupling shaft part 1111. As illustrated in FIG. 38, the moving body 1000 may be inserted into a space in which the rail 440 is formed inside the housing 1001 and move along the rail 440 using the wheels 1120. Consequently, the moving body 1000 may easily move along on the rail 440*b* in the shape of the curve. The movement of the moving body 1000 may also be performed by a power device such as a motor and the like provided inside the moving body 1000.

Figure 40:
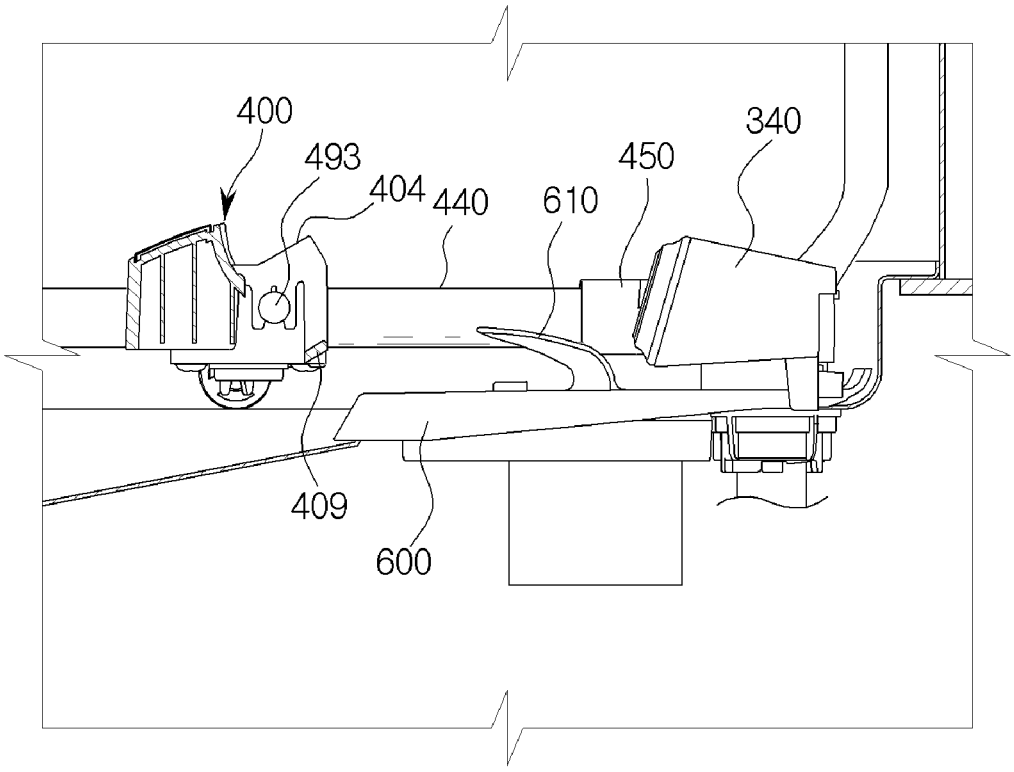
FIGS. 40 to 42 are views for describing an operation of the reflecting module.
Figure 41:
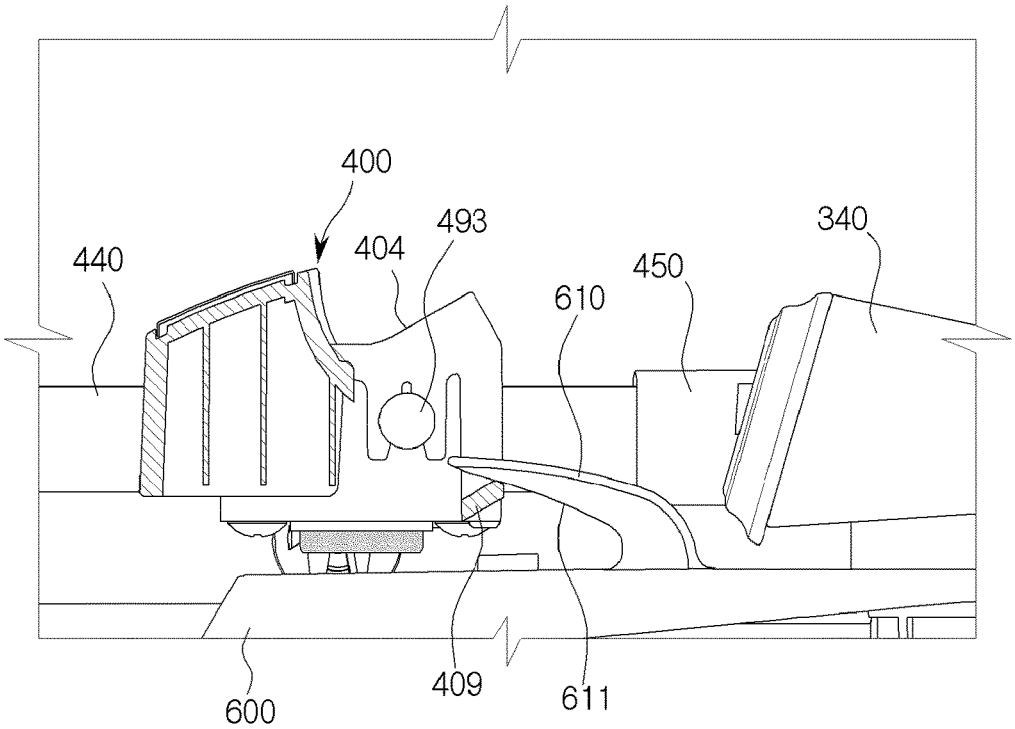
Figure 42:
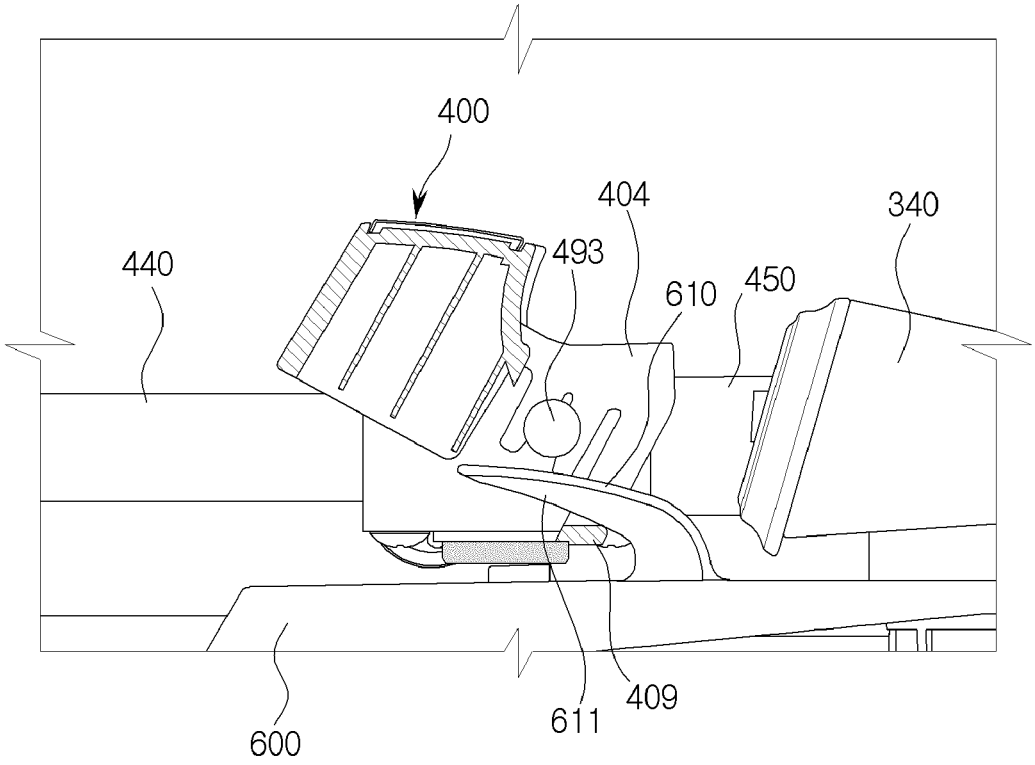
Figure 43:
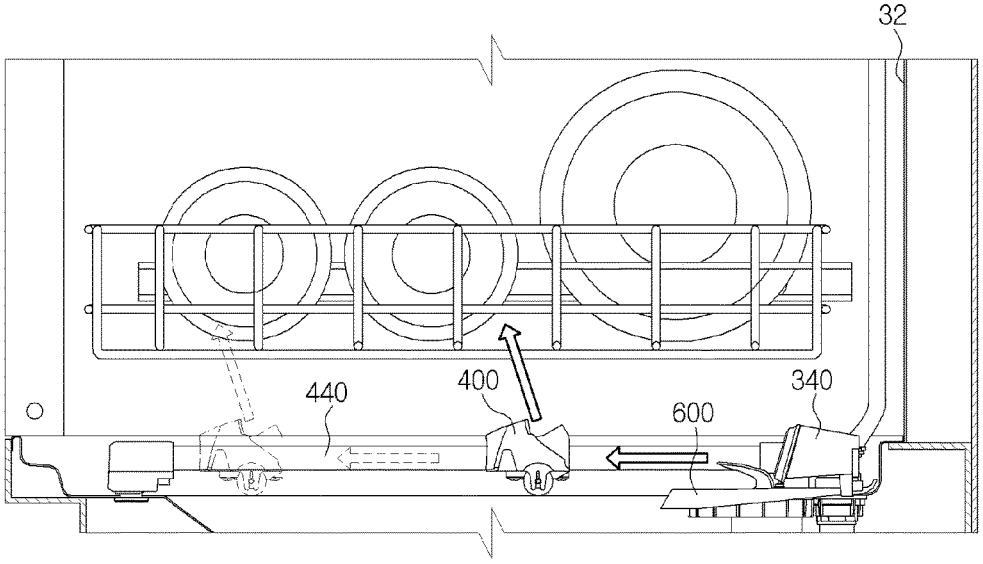
FIGS. 43 and 44 are views for describing a process of reflecting wash water by the reflecting module.
Figure 44:
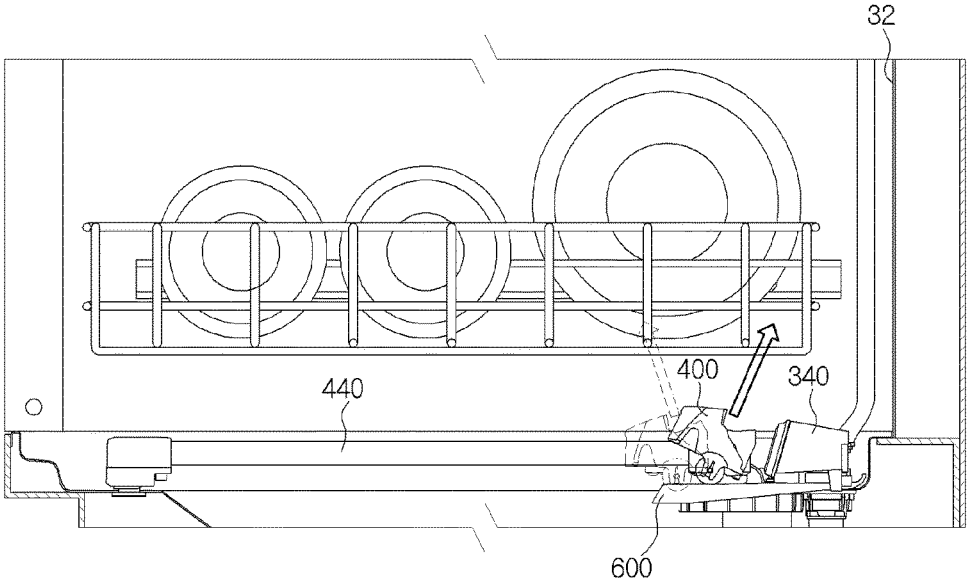

Hereinafter, referring to FIGS. 40 to 44, an operation of the reflecting module will be described. FIGS. 40 to 42 are views for describing an operation of the reflecting module, and FIGS. 43 and 44 are views for describing a process of reflecting wash water by the reflecting module. When the fixed spray nozzles 330 and 340 of the dishwasher 1 spray wash water, the sprayed wash water may be reflected toward dishes by the reflecting module 400. Consequently, the reflecting module 400 may be disposed at a position capable of reflecting the wash water sprayed by the fixed spray nozzles 330 and 340. When the fixed spray nozzles 300 and 340 substantially horizontally spray the wash water, the reflecting module 400 may be disposed to be substantially horizontal to the fixed spray nozzles 300 and 340. As illustrated in FIGS. 40 to 42, the bottom plate cover 600 may include the rotation guide 610 that protrudes to guide the movement of the reflecting module 400. Meanwhile, as described above, the reflecting module 400 may include the rotation locking part 409 to interfere with the rotation guide 610. The rotation locking part 409 forms a rotation shaft of the reflecting module 400 and is formed above the coupling protrusion unit 493 of the reflecting module holder 490 that transmits a driving force to the reflecting module 400 at the same time. The rotation guide 610 may include a guide surface 611 with which the rotation locking part 409 comes into contact and which is formed as a curved surface to allow the reflecting module 400 to smoothly rotate. As illustrated in FIG. 41, when the reflecting module 400 reaches the rotation locking part 409 while moving toward the fixed spray nozzles 330 and 340 along the rail 440, the rotation locking part 409 of the reflecting module 400 may be interfered with by the guide surface 611 of the rotation guide 610. When a first coupling member is a first coupling groove and a second coupling member is a first coupling protrusion unit 493, the reflecting module 400 may rotate about the first coupling protrusion unit 493. Consequently, as illustrated in FIGS. 43 and 44, a direction in which the wash water reflected by the reflecting module 400 moves when the reflecting module 400 is disposed at a section away from the fixed spray nozzles 330 and 340 and a direction in which the wash water reflected by the reflecting module 400 moves when the reflecting module 400 is disposed at a section adjacent to the fixed spray nozzles 330 and 340 may be different from each other.

Figure 45:
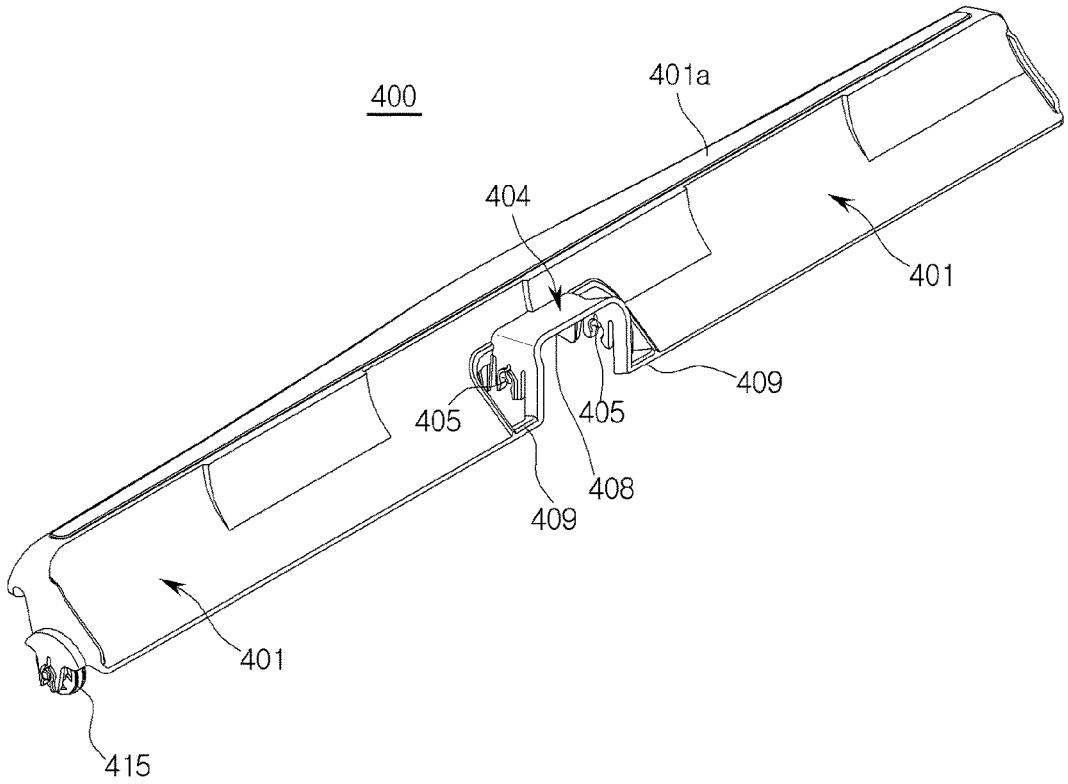
FIGS. 45 and 46 are views illustrating another embodiment of the reflecting module.
Figure 46:
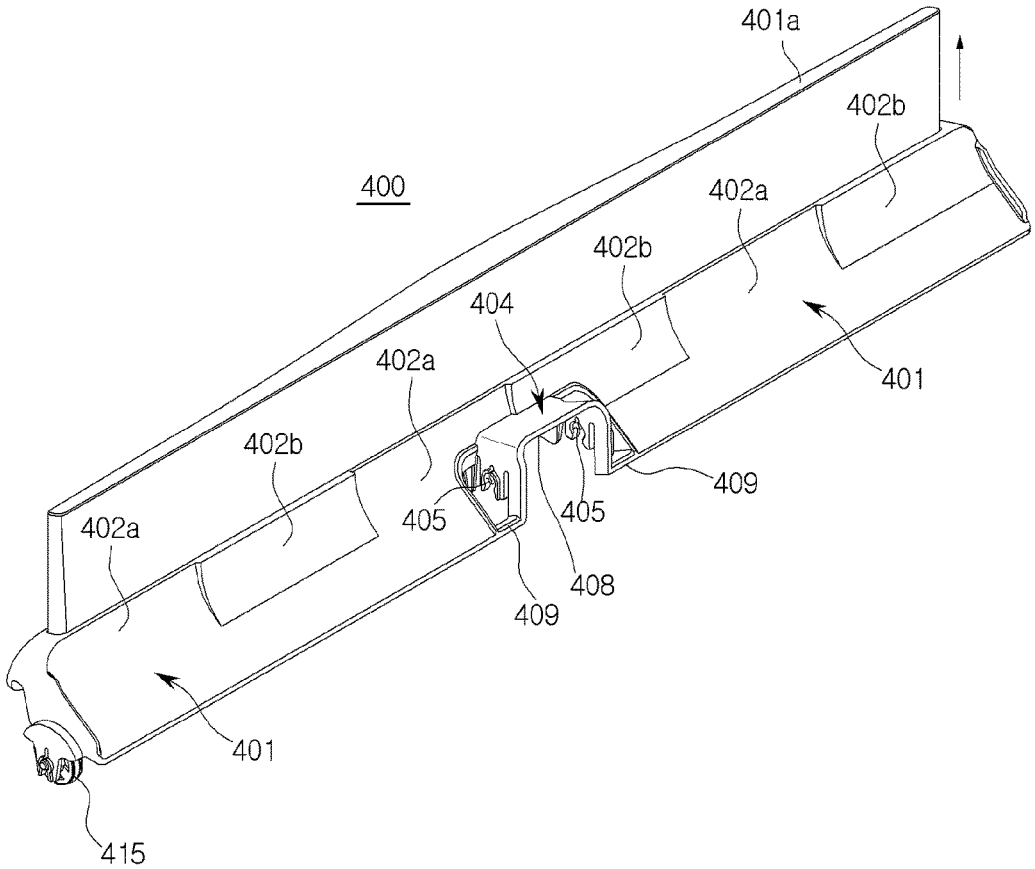
Figure 47:
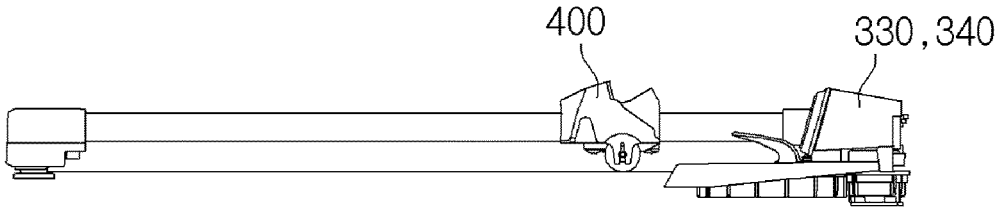
FIGS. 47 and 48 are views for describing an operation of another embodiment of the reflecting module.
Figure 48:
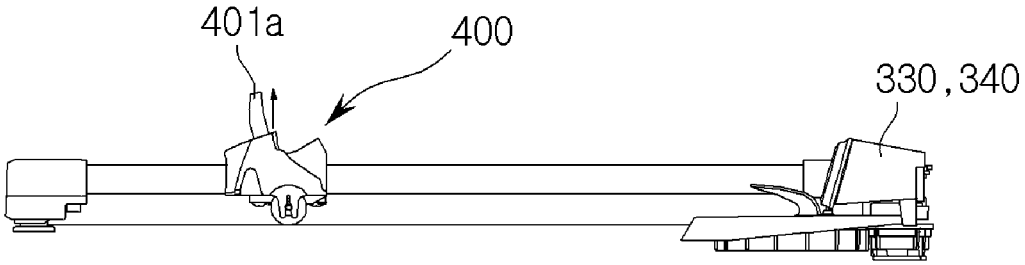

FIGS. 45 and 46 are views illustrating another embodiment of the reflecting module, and FIGS. 47 and 48 are views for describing an operation of another embodiment of the reflecting module. According to an embodiment, a size of the reflecting module 400 may be changed. As illustrated in FIGS. 45 and 46, the reflecting module 400 may include a second reflecting surface 401*a*. The second reflecting surface 401*a* may be disposed at a rear surface of a first reflecting surface 401. The second reflecting surface 401*a* may move upward and protrude from the rear surface of the first reflecting surface 401. Accordingly, a size of the reflecting surface of the reflecting module 400 can expand. Consequently, the reflecting module 400 is able to reflect the wash water in a wider area such that the wash water may stably reach the reflecting module 400. Consequently, efficiency of washing can be improved. As illustrated in FIGS. 47 and 48, protrusion of the second reflecting surface 401*a* may be determined according to the distance between the reflecting module 400 and the nozzles 330 and 340. For example, the second reflecting surface 401*a* may be inserted into the reflecting module 400 when the reflecting module 400 and the nozzles 330 and 340 are close to each other, and the second reflecting surface 401*a* may protrude from the inside the reflecting module 400 when the reflecting module 400 and the nozzles 330 and 340 are spaced apart by a predetermined distance or more.

Figure 49:
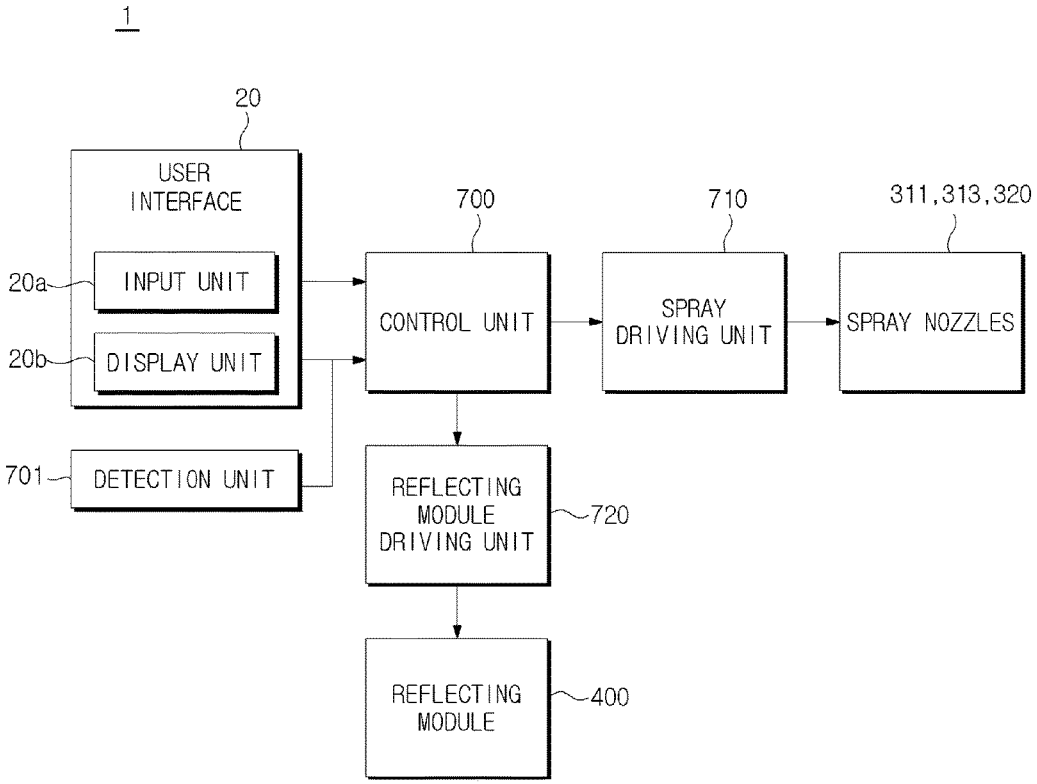
FIG. 49 is a structural view of a dishwasher for describing a process of controlling the dishwasher.

FIG. 49 is a structural view of a dishwasher for describing a process of controlling the dishwasher. According to what is illustrated in FIG. 26, the dishwasher 1 may include the user interface 20, a control unit 700, a spray driving unit 710, a reflecting module driving unit 720, the spray nozzles 311, 313, and 320, the reflecting module holder 490, and the reflecting module 400. In addition, the dishwasher 1 may further include a detection unit 701 for detecting a position of the reflecting module 400 as needed.

The user interface 20 may be provided at the outer surface of the main body 10. The user interface 20 may include the input unit 20*a*, the display unit 20*b*, or the like as described above.

The control unit 700 may control an operation of the dishwasher 1 according to predefined settings or a user's instruction received through the input unit 20*a* of the user interface 20. The control unit 700 may control spray pressures of the nozzles 430 and 440 of the fixed nozzle assembly 320 according to the position of the reflecting module 400. In addition, the control unit 700 may determine wash water spray angles, wash water spray heights, or the like of the nozzles 330 and 340 according to the position of the reflecting module 400, and control the nozzles 330 and 340 according to the determined result. Furthermore, the control unit 700 may also determine whether to protrude the second reflecting surface 401*a* of the reflecting module 400 according to the position of the reflecting module 400, and control the reflecting module 400 according to the determined result.

The control unit 700 may be implemented with a semiconductor chip and a printed circuit board on which the semiconductor chip may be installed. The semiconductor chip may perform at least one of controlling, computing, and storing functions. The semiconductor chip and the printed circuit board may be installed at any place of the dishwasher 1 according to a designer's choice. For example, the semiconductor chip and the printed circuit board may be installed inside a housing that forms the door 11 of the dishwasher 1 or may also be installed at an upper portion or a lower portion of the main body 10 of the dishwasher 1.

The detection unit 701 may detect the position of the reflecting module 400. The detection unit 701 may also detect a distance between the reflecting module 400 and the fixed nozzle assembly 320 to detect the position of the reflecting module 400. The detection unit 701 may detect the position of the reflecting module 400 using infrared rays, visible rays, ultrasonic waves, or various electromagnetic waves. The detection unit 701 may also be implemented using various sensors such as an optical sensor, an infrared sensor, or an ultrasonic sensor.

The spray driving unit 710 may generate a driving force to allow the wash water to be sprayed by the nozzle assemblies 311, 313, 330, and 340 according to a control command of the control unit 700. According to an embodiment, the spray driving unit 710 may include the circulation pump 51 and the drainage pump 52. The circulation pump 51 of the spray driving unit 710 may use a BLDC motor. The spray driving unit 710 may change the transfer force of the circulation pump 51 according to a control command of the control unit 700 to increase or decrease the spray pressure of the wash water sprayed by the nozzles 430 and 440.

The reflecting module driving unit 720 may generate a driving force that moves the reflecting module holder 490 to which the reflecting module 400 is coupled in a predetermined direction to allow the reflecting module 400 to move within the wash tub 30. The reflecting module driving unit 720 may include the motor 530 connected to the drive pulley 500. According to an embodiment, the reflecting module driving unit 720 may also include a pneumatic actuator or a hydraulic actuator.

Figure 50:
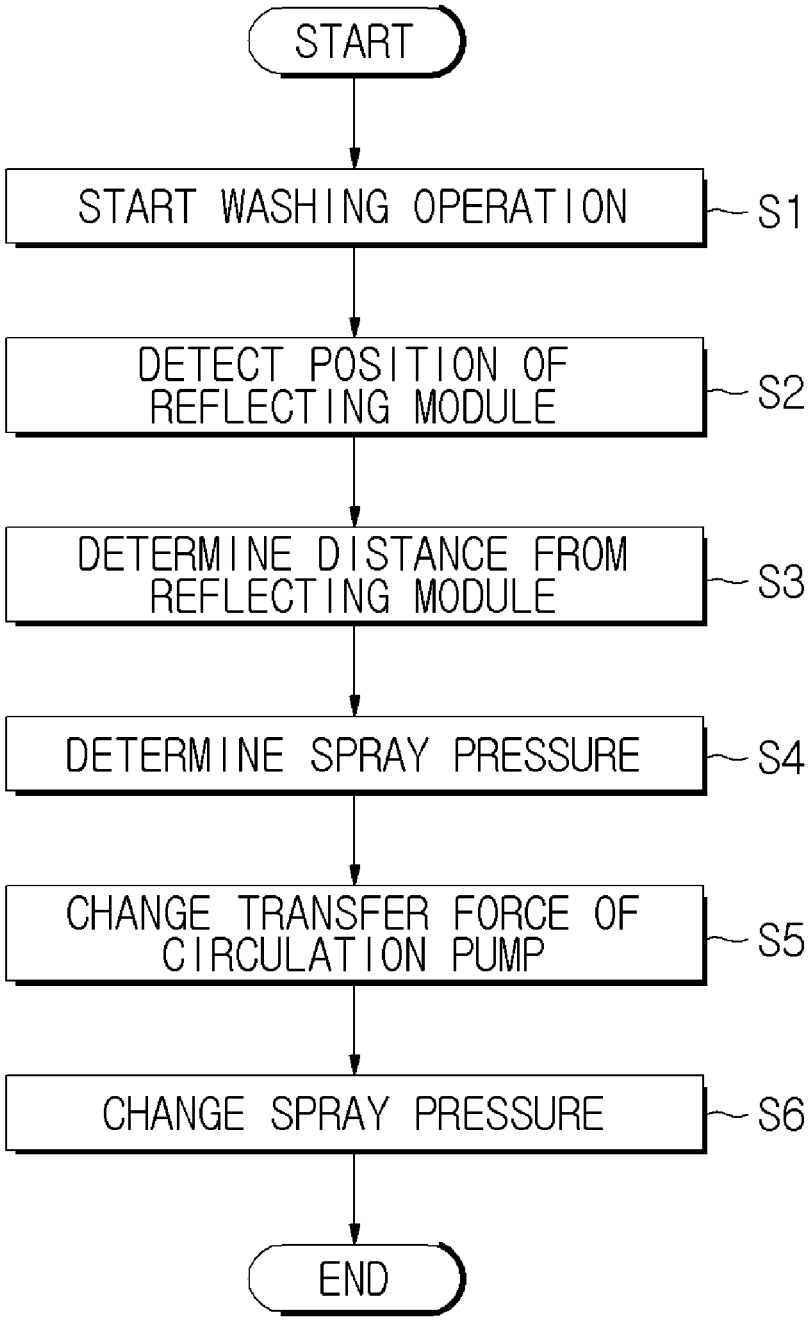
FIG. 50 is a flowchart of a process of controlling a spray pressure of the nozzle according to a position of the reflecting module.
Figure 51:
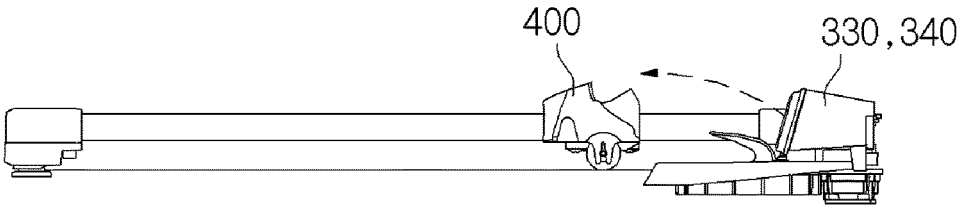
FIGS. 51 and 52 are views for describing the process of controlling the spray pressure of the nozzle according to the position of the reflecting module.
Figure 52:
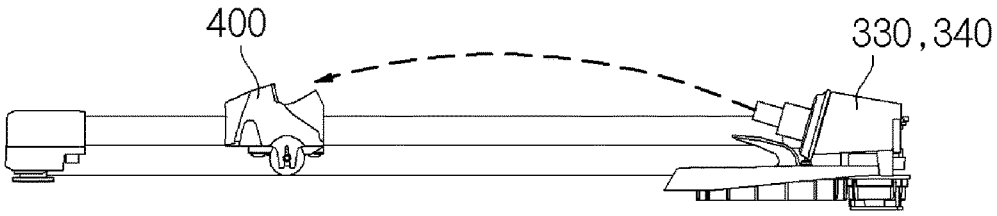

FIG. 50 is a flowchart of a process of controlling a spray pressure of a nozzle according to a position of the reflecting module, and FIGS. 51 and 52 are views for describing the process of controlling the spray pressure of the nozzle according to the position of the reflecting module.

According to what is illustrated in FIG. 50, when the dishwasher 1 begins a washing operation 51, the circulation pump 51 may transfer wash water stored in the sump 100 to each of the nozzles 311, 313, and 320 in the dishwasher 1, and each of the nozzles 311, 313, and 320 may spray the wash water. Simultaneously, the reflecting module 400 may move along the rail 440. The reflecting module 400 may also perform a linearly reciprocating motion.

The detection unit 701 may detect a position of the reflecting module 400 which is moving and output an electrical signal S2. The detection unit 701 may also detect the position of the reflecting module 400 every predefined period.

The control unit 700 may determine a distance between the reflecting module 400 and the fixed nozzle assembly 320 based on the electrical signal output by the detection unit 701 S3.

The control unit 700 may determine a spray pressure according to the distance between the reflecting module 400 and the fixed nozzle assembly 320 S4. According to an embodiment, when there is a short distance between the reflecting module 400 and the nozzles 330 and 340 as illustrated in FIG. 51, the control unit 700 may determine the spray pressure to be relatively low. In addition, when there is a long distance between the reflecting module 400 and the nozzles 330 and 340 as illustrated in FIG. 52, the control unit 700 may determine the spray pressure to be relatively high to allow the wash water sprayed by the nozzles 330 and 340 to sufficiently reach the reflecting module 400.

The control unit 700 may determine the spray pressure and then generate a control signal that controls the circulation pump 51 according to the determined spray pressure to transmit the control signal to the circulation pump 51 of the spray driving unit 710.

The circulation pump 51 may change a transfer force based on the control command of the control unit 700 S5. In this case, the circulation pump 51 may increase the transfer force to increase the spray pressure when there is a long distance between the reflecting module 400 and the nozzles 330 and 340 and may decrease the transfer force to decrease the spray pressure when there is a short distance between the reflecting module 400 and the nozzles 330 and 340.

Since wash water spray pressures of the nozzles 330 and 340 are also changed when the circulation pump 51 changes the transfer force, the wash water spray pressures may be controlled according to the position of the reflecting module 400 as illustrated in FIGS. 51 and 52. Consequently, the sprayed wash water may properly reach the reflecting module 400.

INDUSTRIAL APPLICABILITY

The dishwasher and the method for controlling the same are industrially applicable due to being able to be used in households or industrial sites.

The invention claimed is:

1. A dishwasher comprising:

a wash tub;

a spray nozzle configured to spray wash water inside the wash tub;

a circulation pump configured to transfer the wash water to the spray nozzle;

a reflecting module movable inside the wash tub and configured to reflect the wash water sprayed by the spray nozzle; and a control unit configured to control a spray pressure at which the wash water is sprayed by controlling a transfer force of the circulation pump according to a distance between the spray nozzle and the reflecting module.

2. The dishwasher of claim 1, further comprising:

a sump configured to retain the wash water, wherein the circulation pump is further configured to transfer the wash water retained in the sump to the spray nozzle.

3. The dishwasher of claim 2, wherein the circulation pump includes a brushless direct current (BLDC) motor.

4. The dishwasher of claim 1, further comprising a detection unit configured to detect a position of the reflecting module.

5. The dishwasher of claim 1, wherein at least one of a wash water spray height and a wash water spray angle of the spray nozzle is controllable.

6. The dishwasher of claim 1, wherein a length of the spray nozzle is varied.

7. The dishwasher of claim 1, wherein a spray angle of the spray nozzle is controllable by a reaction force of the sprayed wash water.

8. The dishwasher of claim 1, further comprising a rail assembly that includes a rail configured to guide a movement of the reflecting module.

9. The dishwasher of claim 8, wherein the rail is in an inclined shape to descend in an opposite direction of the spray nozzle.

10. The dishwasher of claim 8, wherein the rail is in a shape of a curve having a central portion protruding upward.

11. The dishwasher of claim 1, wherein the reflecting module includes a first reflecting surface disposed at a front surface and a second reflecting surface disposed behind the first reflecting surface, and the second reflecting surface moves to be able to protrude from the reflecting module.

12. A method for controlling a dishwasher that includes a circulation pump configured to transfer wash water, a spray nozzle configured to spray the wash water transferred by the circulation pump, and a reflecting module that is movable inside a wash tub and reflects the wash water sprayed by the spray nozzle, the method comprising:

detecting a position of the reflecting module and determining a distance between the reflecting module and the spray nozzle based on the detected position;

determining a spray pressure of the spray nozzle according to the distance between the reflecting module and the spray nozzle;

changing a transfer force of the circulation pump based on the determined spray pressure; and changing the spray pressure according to the changed transfer force of the circulation pump.

* * * * *